US010287142B2

(12) United States Patent
Roodenburg et al.

(10) Patent No.: US 10,287,142 B2
(45) Date of Patent: May 14, 2019

(54) CRANE BOOM SEGMENT FOR ASSEMBLY OF A CRANE BOOM, METHOD FOR ASSEMBLING A CRANE BOOM

(71) Applicant: ITREC B.V., Schiedam (NL)

(72) Inventors: Joop Roodenburg, Delft (NL); Gijsbert Schouten, Capelle Aan Den Ijssel (NL)

(73) Assignee: ITREC B.V., Schiedam (NL)

( * ) Notice: Subject to any disclaimer, the term of this patent is extended or adjusted under 35 U.S.C. 154(b) by 216 days.

(21) Appl. No.: 15/034,785

(22) PCT Filed: Nov. 8, 2013

(86) PCT No.: PCT/NL2013/050797
§ 371 (c)(1),
(2) Date: May 5, 2016

(87) PCT Pub. No.: WO2015/069096
PCT Pub. Date: May 14, 2015

(65) Prior Publication Data

US 2016/0264384 A1 Sep. 15, 2016

(51) Int. Cl.
*B66C 23/70* (2006.01)
*B66C 23/36* (2006.01)

(52) U.S. Cl.
CPC ..... *B66C 23/70* (2013.01); *B66C 23/365* (2013.01)

(58) Field of Classification Search
CPC ..... B66C 23/00; B66C 23/365; B66C 23/62; B66C 23/64; B66C 23/70
(Continued)

(56) References Cited

U.S. PATENT DOCUMENTS 4,166,542 A * 9/1979 Bryan, Jr. ..... B66C 23/703 212/231
4,498,596 A * 2/1985 Haulotte ..... B66C 23/36 212/223
(Continued)

FOREIGN PATENT DOCUMENTS

CN 102216538 A 10/2011
CN 102249161 A 11/2011
(Continued)

OTHER PUBLICATIONS

European Office Action dated Jul. 28, 2017, for European Application No. 13801874.2.

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A Crane boom segment is provided for assembly of a crane boom by interconnection of multiple crane boom segments from a transport configuration to an operational configuration. The crane boom segment includes a first and second planar latticed truss, each with two chords between which permanent lacing elements extend. Both chords of each planar latticed truss include segment connection parts at their head ends allowing crane boom segments to be connected to each other in series, and in the operational configuration the first and second planar latticed trusses are provided at opposite sides of the longitudinal axis of the crane boom segment. A crane boom segment further includes a first and second lattice web, each lattice web connectable to one of the chords of the first planar latticed truss and one of the chords of the second planar latticed truss. A modular crane includes a travelling base frame which allows for travel of said crane over a surface, and a crane boom assembled from crane boom segments, one end
(Continued)

Figure 1:
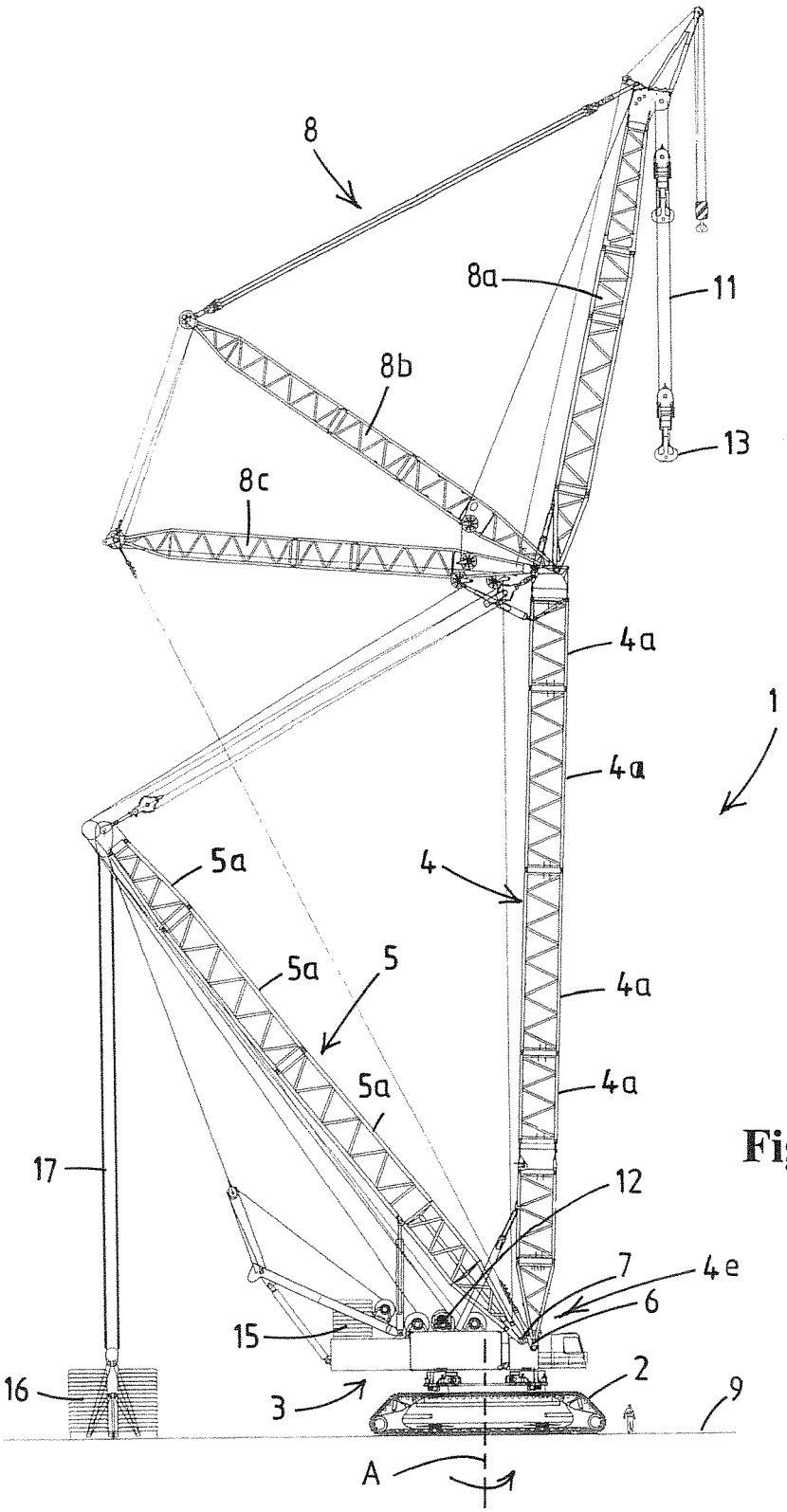

of the crane boom being hingedly connected about a substantially horizontal pivot axis to said travelling base frame.

5 Claims, 15 Drawing Sheets

(58) Field of Classification Search
USPC ..... 52/646, 117
See application file for complete search history.

(56) References Cited

U.S. PATENT DOCUMENTS

| | | | | |
|---|---|---|---|---|
| 5,005,714 | A * | 4/1991 | Kroll | B66C 23/36 212/178 |
| 5,586,667 | A * | 12/1996 | Landry | B66C 23/76 212/195 |
| 5,820,184 | A * | 10/1998 | Echenay | B66C 1/22 294/81.2 |
| 6,460,307 | B1 * | 10/2002 | Blain, III | B66C 23/44 212/175 |
| 7,478,852 | B1 * | 1/2009 | Durden | B66C 1/10 294/81.2 |
| 7,703,615 | B2 * | 4/2010 | Willim | B66C 23/70 212/175 |
| 2003/0041548 | A1 | 3/2003 | Merrifield | |
| 2008/0173605 | A1 | 7/2008 | Willim | |
| 2010/0326004 | A1 * | 12/2010 | Daas | B66C 23/70 52/646 |
| 2011/0284490 | A1 | 11/2011 | Liu et al. | |
| 2011/0290751 | A1 * | 12/2011 | Yamaguchi | B66C 23/64 212/347 |
| 2012/0031868 | A1 | 2/2012 | Willim | |
| 2012/0110946 | A1 | 5/2012 | Daas et al. | |

FOREIGN PATENT DOCUMENTS

| | | | |
|---|---|---|---|
| CN | 102674168 | A | 9/2012 |
| DE | 202008014059 | U1 | 3/2010 |
| DE | 202011002589 | U1 | 7/2011 |
| DE | 202010011131 | U1 | 1/2012 |
| EP | 1935833 | A1 | 6/2008 |
| JP | 2003-118980 | A | 4/2003 |
| NL | 1020779 | C2 | 12/2003 |
| NL | 1029406 | C2 | 1/2007 |

* cited by examiner

CRANE BOOM SEGMENT FOR ASSEMBLY OF A CRANE BOOM, METHOD FOR ASSEMBLING A CRANE BOOM

The present invention relates generally to the field of load-lifting cranes, and more particularly to crane boom segments for assembly of a crane boom by interconnection of multiple crane boom segments from a transport configuration to an operational configuration. Crane booms are typically comprised of individual crane boom segments connected end-to-end. The boom segments are usually formed in specific lengths, e.g., 10, 20, 40 ft. Thus, the length of a crane boom can be tailored to fit each individual lift.

A crane boom segment has a substantially rectangular cross section and a longitudinal axis. In general, crane boom segments are known, comprising:

- a first and second planar latticed truss, each with two chords between which permanent lacing elements extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment;
- a first and second lattice web, each lattice web connectable to one of the chords of the first planar latticed truss and one of the chords of the second planar latticed truss.

In the operational configuration, the lattice webs extend between opposed chords of the planar latticed trusses.

It is well known that greater strengths are required of the crane boom when greater loads are to be lifted. The strength of a crane boom is a dependent on the distance of the planar latticed trusses and the lattice webs from the longitudinal axis of the boom segment.

One method of increasing the strength of a boom without significantly increasing the amount of material used in the boom segments (and hence the weight of the boom) is to space the planar latticed trusses and/or the lattice webs further from the longitudinal axis of the boom segment. This, however, increases the overall width and/or height of the boom segment. Transportability problems arise with crane boom segments of large dimension. If any of the dimensions is too large, the crane boom segments cannot be transported in containers, along highways, railways and the like due to size restrictions. Thus, difficulties arise in moving crane booms of large dimensions to job sites.

A possible approach to overcome this problem consists of transporting the individual parts of each crane boom segment to the specific jobsite and constructing the crane boom segments on-site. To produce the numerous required connections of the structural elements on-site is a time-consuming and labor-intensive construction, and has an increased chance that errors in assembly are made.

It is an object of the first and second aspect present invention to create crane boom segments with the features described herein, wherein the transportability problem of crane boom segments is solved without the need for difficult and time-consuming construction of individual crane boom segments on the job site.

According to the first aspect of the invention, a crane boom segment is provided wherein the first and second lattice webs are accordion-type lattice webs, each composed of multiple straight elements that are pivotably interconnected in series by hinges each having a pivot axis, wherein in the folded transport configuration the straight elements are essentially parallel to each other, and in the operational configuration the interconnected straight elements have been pivoted open to form V-shaped pairs of straight elements, and wherein the hinges each comprise a fastener member and the chords are provided with complementary fastener members to allow the accordion-type lattice web in the operational configuration connected to the chords.

This configuration is highly advantageous in view of transportation, as the planar latticed trusses can be stacked in order to be transported, as well as the collapsed, folded-in accordion-type lattice webs. E.g., transport containers are provided, suitable to stack planar latticed trusses, while other containers transport multiple folded-in accordion-type lattice webs. This allows a compact transport configuration of the crane boom segments, while the large dimensions of the crane boom segment in the operational position are possible.

Another advantage of the connection of the lattice web to the chords of the planar latticed trusses on-site is that a variety of lattice webs and/or planar latticed trusses having deviating strength and weight properties may be available, introducing a design flexibility with crane boom segments having on-demand properties.

The invention also relates to a crane boom segment for assembly of a crane boom by interconnection of multiple crane boom segments from a transport configuration to an operational configuration wherein the crane boom segment has a substantially rectangular cross section and a longitudinal axis, the crane boom segment comprising:

- first and second planar latticed trusses, each with two chords between which a lacing structure extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment;
- a first and second lattice web, each lattice web connectable to one of the chords of the first planar latticed truss and one of the chords of the second planar latticed truss;

and wherein the lacing structure is an accordion-type lacing structure, composed of multiple straight elements that are pivotably interconnected in series by hinges each having a pivot axis, wherein in the folded transport configuration the straight elements are essentially parallel to each other, and in the operational configuration the interconnected straight elements have been pivoted open to form V-shaped pairs of straight elements, and wherein the hinges each comprise a fastener member and the chords are provided with complementary fastener members to allow the accordion-type lacing structure in the operational configuration connected to the chords.

Preferably, also the first and second lattice webs are accordion-type lattice webs, each composed of multiple straight elements that are pivotably interconnected in series by hinges each having a pivot axis, wherein in the folded transport configuration the straight elements are essentially parallel to each other, and in the operational configuration the interconnected straight elements have been pivoted open to form V-shaped pairs of straight elements, and in that the hinges each comprise a fastener member and the chords are provided with complementary fastener members to allow the accordion-type lattice web in the operational configuration connected to the chords.

By providing both the lattice webs and the latticed trusses as accordion-type webs and trusses, a very compact transport configuration is possible.

The invention also relates to a method of constructing a crane boom by interconnecting multiple crane boom segments, each crane boom segment comprising:

a first and second planar latticed truss, each with two chords between which permanent lacing elements extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment;

a first and second lattice web, each lattice web connectable to one of the chords of the first planar latticed truss and one of the chords of the second planar latticed truss, wherein the first and second lattice webs are accordion-type lattice webs, each composed of multiple straight elements that are pivotably interconnected in series by hinges each having a horizontal pivot axis perpendicular to the longitudinal axis of the crane boom segment, wherein in the folded transport configuration the straight elements are essentially parallel to each other, and in the operational configuration the interconnected straight elements have been pivoted open to form V-shaped pairs of straight elements, and wherein the hinges each comprise a fastener member and the chords are provided with complementary fastener members to allow the accordion-type lattice web in the operational configuration connected to the chords;

wherein the method comprises the steps of:

pivoting the interconnected straight elements of both accordion-type lattice webs open from the transport configuration to the operation configuration to form V-shaped pairs of straight elements;

connecting the fastener members of the hinges of the accordion-type lattice webs to the complementary fastener members of the chords of the planar latticed trusses to form a crane boom segment;

interconnecting crane boom segments in series by connecting the segment connection parts at the head ends of the chords.

Advantageously, the interconnected straight elements are opened to the operational configuration by a forklift or the like. Advantageously, a spreader beam is available that can lift one or both lattice webs in the operational configuration and position the lattice web(s) on the first planar latticed truss, allowing the lattice webs to be connected to the first planar latticed truss. Once both lattice webs are connected to the first planar latticed truss, the spreader beam may be used to position the second planar latticed truss above the lattice webs, allowing the lattice webs to be connected to the second planar latticed truss.

According to the second aspect of the invention, a crane boom segment is provided for assembly of a crane boom by interconnection of multiple crane boom segments from a transport configuration to an operational configuration wherein the crane boom segment has a substantially rectangular cross section and a longitudinal axis, the crane boom segment comprising:

a first and second planar latticed truss, each with two chords between which permanent lacing elements extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment;

a first and second lattice web, each lattice web connectable to one of the chords of the first planar latticed truss and one of the chords of the second planar latticed truss;

wherein in the operational configuration the height of the first and second lattice webs exceeds the width of the first and second planar latticed trusses;

wherein each of the lattice webs is composed of multiple straight rods forming triangular and diamond-shaped units, each straight rod being pivotably connected at one end via a chord hinge to a chord about a pivot axis parallel to the chord, and at the other end being pivotably connected to another straight rod via a central hinge about a parallel pivot axis, wherein the central hinges of the first and second lattice webs are offset, allowing the central hinges of a lattice web to move away from the plane of the lattice web in the operational configuration, to be folded to a transport configuration whereby the straight rods of the first lattice web and the straight rods of the second lattice web nest into each other.

This advantageous configuration allows the crane boom segment to be folded together, by allowing the central hinges of a lattice web to move away from the plane of the lattice web in the operational configuration, towards the opposed latticed web, and vice versa, in an operation similar to a collapsible folding plastic crate, used for groceries and/or storage.

It is unique to the invention that the central hinges of the first and second lattice webs are offset. This allows an operational configuration wherein the height of the first and second lattice webs exceeds the width of the first and second planar latticed trusses, hence, wherein the distance of the planar latticed trusses from the longitudinal axis of the boom segment are larger than the distance of the lattice webs from the longitudinal axis of the boom segment. This results in advantageous properties of the crane boom, in particular in view of its strength. Because the central hinges of the first and second lattice webs are offset, the straight rods of the first lattice web and the straight rods of the second lattice web are allowed to nest into each other and provide an efficiently stacked configuration with the planar latticed trusses on the outside, and the straight rods of the lattice webs efficiently folded together therebetween.

The invention also relates to crane boom segments for assembly of a crane boom by interconnection of multiple crane boom segments from a transport configuration to an operational configuration wherein the crane boom segment has a substantially rectangular cross section and a longitudinal axis, the crane boom segment comprising:

a first and second planar latticed truss, each with two chords between which permanent lacing elements extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment;

a first and second lattice web, each lattice web connectable to one of the chords of the first planar latticed truss and one of the chords of the second planar latticed truss;

characterized in that each of the lattice webs is composed of multiple straight rods forming triangular and diamond-shaped units, each straight rod being pivotably connected at one end via a chord hinge to a chord about a pivot axis parallel to the chord, and at the other end being pivotably connected to another straight rod via a central hinge about a parallel pivot axis, wherein the central hinges of the first and second lattice webs are offset, allowing the central hinges of a lattice web to move away from the plane of the lattice web in the operational configuration, to be folded to a transport configuration.

In this embodiment, in the operational configuration the height of the first and second lattice webs and the width of the first and second planar latticed trusses can be similar, or one exceeding the other as desired.

Hence, crane boom segments embodied according to the first or second aspect of the invention are composed of prefabricated planar latticed trusses and lattice webs, having overall dimensions in the operational configuration which are advantageous in view of the strength of the crane boom, preferably wherein the height of the first and second lattice webs exceeds the width of the first and second planar latticed trusses. The crane boom segments embodied according to the first or second aspect of the invention are transfigurable between the operational configuration and a transport configuration, wherein the crane lattice webs are folded to reduce the overall dimension of the crane boom segment, preferably to the maximum allowable shipping dimensions, allowing the crane boom segments to be transported.

Another object of the present invention is to increase the design flexibility with crane boom segments. This is achieved according to a third aspect of the invention by the provision of crane boom segments, the strength of which being adjustable strength.

Crane boom segments for assembly of a crane boom are known, in particular by interconnection of multiple crane boom segments from a transport configuration to an operational configuration wherein the crane boom segment has a substantially rectangular cross section and a longitudinal axis. Such a known crane boom segment comprises a first and second planar latticed truss, each with two chords between which permanent lacing elements extend; wherein both chords of each planar latticed truss comprise segment connection parts at their head ends allowing crane boom segments to be connected to each other in series; wherein in the operational configuration the first and second planar latticed trusses are provided at opposite sides of the longitudinal axis of the crane boom segment; and a first and second lattice web, each lattice web connectable to one of the chords of the first planar latticed truss and one of the chords of the second planar latticed truss.

Advantageously, but not necessarily, the lattice webs are embodied according to the first or second aspect of the present invention.

According to the third aspect of the invention, a crane boom segment further comprises at least a third planar latticed truss, wherein each of the chords of the first planar latticed truss and each of the chords of the third planar latticed truss are provided with mating chord fastener members, and wherein in the operation configuration the third planar latticed truss is connected directly onto of the first planar latticed truss by providing a connection between the chord fastener members.

This is in particular advantageous when modular designs are envisaged, in particular scalable designs. In usage-optimized configurations the segments can be assembled into a 'normal' crane configuration, but connecting a larger number of segments together enables large or even very large crane configurations. By providing a crane boom segment having an adjustable strength, the capacity of a boom made from crane boom segments can be adjusted.

As such, the capacity of the boom, in particular in view of the strength of the boom, increases by providing an extra planar latticed truss onto of the planar lattice truss of the boom segment, forming a stack of two planar latticed trusses.

Possibly, a crane boom segment further comprises a fourth planar latticed truss, wherein each of the chords of the second planar latticed truss and each of the chords of the fourth planar latticed truss are provided with mating chord fastener members, and wherein in the operation configuration the fourth planar latticed truss is connected directly onto of the second planar latticed truss by providing a connection between the chord fastener members. As such, additional planar latticed trusses are provided on both planar lattice trusses that are present, hence, a crane boom segment is provided with two double-fitted planar latticed trusses.

In an embodiment, the mating chord fastener members are embodied as pin-receiving holes provided in the chord, and lugs, protruding from the chords, which are aligned with each other in the operational configuration and adapted to receive a pin to allow the chords to be interconnected. Alternative mating chord fastener members, e.g. including bolts and nuts are also conceivable. Preferably, the mating chord fastener members on a planar latticed truss allow the planar latticed truss to lay down onto these mating chord fastener members, in particular in view of the transportability of the planar latticed trusses. In an embodiment, the mating chord fastener members comprise lugs each having a flattened outer surface allowing the planar latticed truss to lay down onto.

Advantageously, a crane boom segment according to the first, second and/or third aspect of the present invention can be used in a large modular crane, allowing extremely high loads can be lifted to large altitudes. With the invention, a crane structure may be quickly erected with a minimum of on-site personnel. Advantageously, the crane boom segments are easily transportable and allow a high degree of portability in terms of compactness and light weight, as the crane boom segments are adapted to be collapsed to compact transport configuration for transport, e.g. shipment and then expanded on-site to the operational configuration for erection and connection to similarly configured crane boom segments.

Preferably, but not necessarily, in the transport configuration the dimensions of the planar latticed trusses and the latticed webs part do not exceed those of a transport container, e.g. a ISO freight container, in particular having a height of not more than 12 feet 11 inches and a width of not more than 9 feet 5 inches. The lengths of such a container may vary from 8 to 56 feet (2.438 to 17.069 m).

Advantageously, a crane boom segments according to the first, second and third aspect of the invention comprise identical first, second and further planar latticed trusses, and it is even more advantageous if also the first and second lattice webs are embodied identical. This allows a modular design, in particular a scalable design. Further, this reduction of the number of different components of a crane boom segment is highly advantageous on-site during assembly as it prevents confusion and errors. On the other hand, it is also conceivable that different types of planar latticed trusses are available, having different strength properties.

In an advantageous embodiment, usage-optimized configurations are possible with the crane boom segments: the segments can be assembled into a 'normal' crane configuration, but connecting a larger number of segments together enables a large or even a very large crane configurations. Preferably, crane booms can be assembled for cranes rating from 50.000 to 240.000 tonne-meters and from 1200 to 4800 tonnes capacity. Advantageously, not only crane booms and crane jibs are suitable for usage-optimized configurations, but also other crane parts such as ring parts, winches and more are transferrable from one size crane to another. Adding more of the same parts together allow larger cranes to be built. Hence, when the largest crane is purchased, one can also build smaller cranes.

The present invention also relates to a crane boom, assembled from crane boom segments according to the first, second and or third aspect of the invention.

The invention further relates to a modular crane, wherein crane boom segments according to the first, second and/or third aspect of the invention are assembled into a crane boom of the modular crane, the modular crane comprising:

- a travelling base frame which allows for travel of said crane over a surface;
- a crane boom assembled from crane boom segments according to the invention, one end of the crane boom being hingedly connected about a substantially horizontal pivot axis, to said travelling base frame.

Such a modular crane is e.g. a crawler crane, mounted on an undercarriage with a set of tracks. Alternatively, the crane boom segments can also advantageously be used in so-called ring-based cranes, which usually have a large boom or a double-boom system (arranged in parallel or in the shape of an "A"), which are supported on the ground by way of a circular track. Both crawler cranes and ring-based cranes comprise a revolving superstructure which is mounted on a base, to which superstructure at least a boom and preferably also a backmast is hingedly mounted. The 'base' in this context may thus be a carriage in the case of a crawler crane, but can alternatively be a vessel or a quay, or on land.

A crane boom assembled from crane boom segments according to the invention is preferably provided with a hoist departing sheave, allowing a hoist cable of a load hoisting device to extend over the hoist departing sheave to hoist a load.

Possible applications for cranes comprising a crane booms according to the first, second or third aspect of the invention include petrochemical plant vessel installation, power plant construction and module construction for the offshore industry.

Preferably, a crane boom segment according to any aspect of the invention is made from high tensile steel, e.g. 960 MPa, to save weight.

All aspects of the invention are described as 'crane boom segments for assembly of a crane boom'. It is noted that a similar configuration of planar latticed trusses and lattice webs according to one or more aspects of the invention may be applied for the assembly of other crane parts, such as a jib or back mast. Hence, where the disclosure indicates 'crane boom segments', this also relates to 'crane jib segments', 'crane back mast segments', etc. etc.

A fourth aspect of the invention relates to a modular crane, comprising

- a travelling base frame which allows for travel of said crane over a surface, the base frame comprising girders assembled from girder segments;
- a crane boom comprising two elongated boom sections, each of which is assembled from crane boom segments, one end the boom sections being connected hingedly to the travelling base frame about a substantially horizontal pivot axis (91A), and the other ends of the boom sections merging towards each other near the top of the crane boom;
- a backmast that is mounted pivotably to said base frame about a parallel horizontal pivot axis;
- a main hoisting device, comprising a main hoisting winch, a main hoist wire that is guided over the crane boom and a hook, connected to the main hoist wire;
- a luffing device, comprising a luffing winch and a luffing cable, extending between the luffing winch, the backmast and the crane boom;

In known modular cranes, the hoisting winches are usually mounted on top of the base frame. The aim of the fourth aspect of the invention is to further improve the crane design, to improve transportability of the modular crane.

This is achieved according to the fourth aspect of the invention in that the main hoisting winch is mounted within a hoist winch frame, the hoist winch frame being embodied as a shipping container comprising connectors at the corners thereof, allowing the hoist winch frame to be assembled into at least one of the girders of the base frame to be integrated in and form part of the base frame.

This modular crane design is advantageous as the incorporation of the winches as part of the base frame and not being present as separate elements added to dispense with unnecessary extra weight of additional structure of the girders.

Preferably, the crane boom segments are according to one or more of the other aspects of the invention.

Preferably, the base frame comprises two parallel main girders to which the crane boom segments and the backmast are connected, and one or more cross-girders provided therebetween, parallel to the aligned horizontal pivot axes of the crane boom segments. Advantageously, the hoist winch frame is adapted to be assembled into a cross-girder. This is advantageous as the hoist winch is parallel to the horizontal pivot axis of the boom sections, and the location enables unhindered use of the main hoist winch.

Figure 2A:
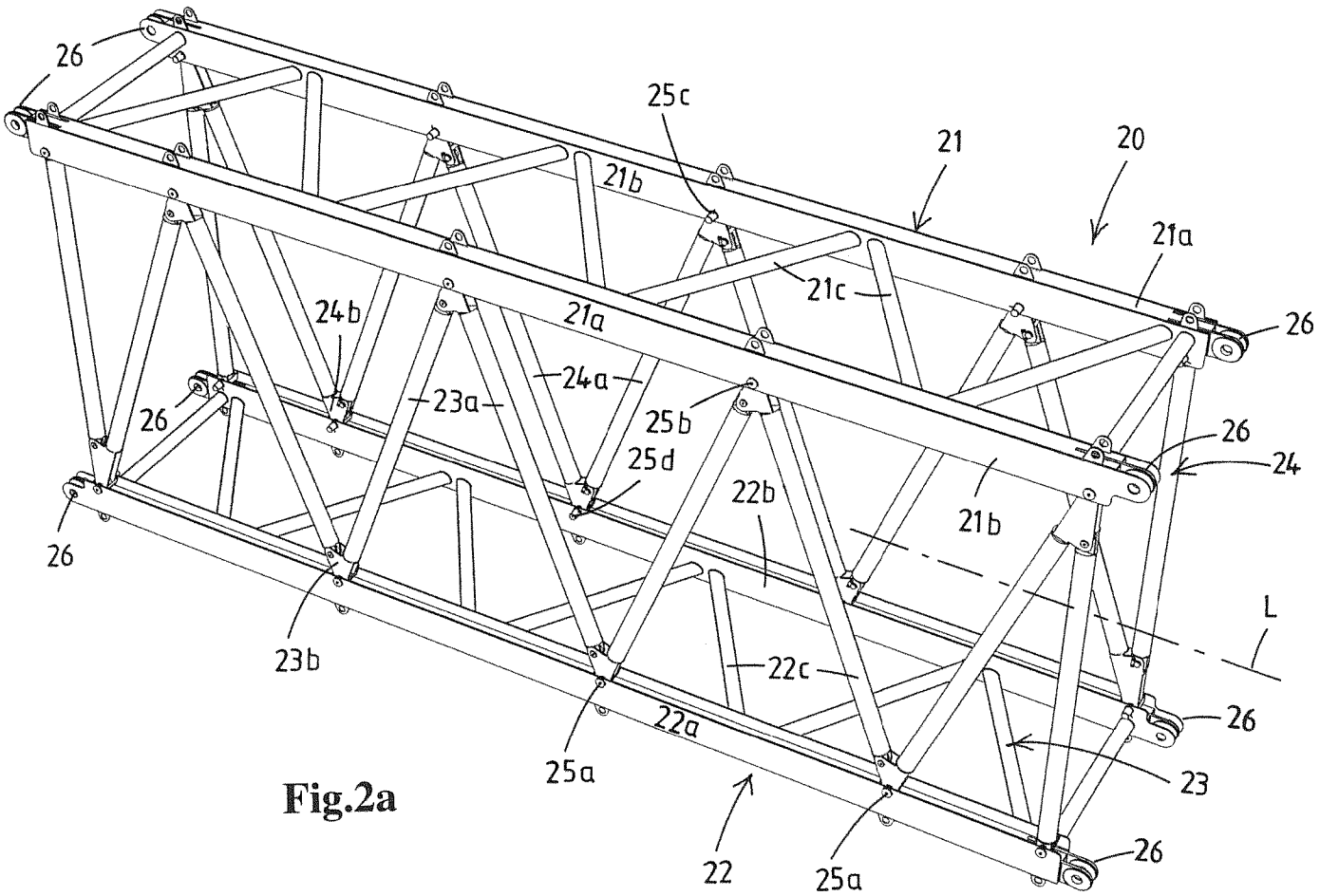
Figure 2B:
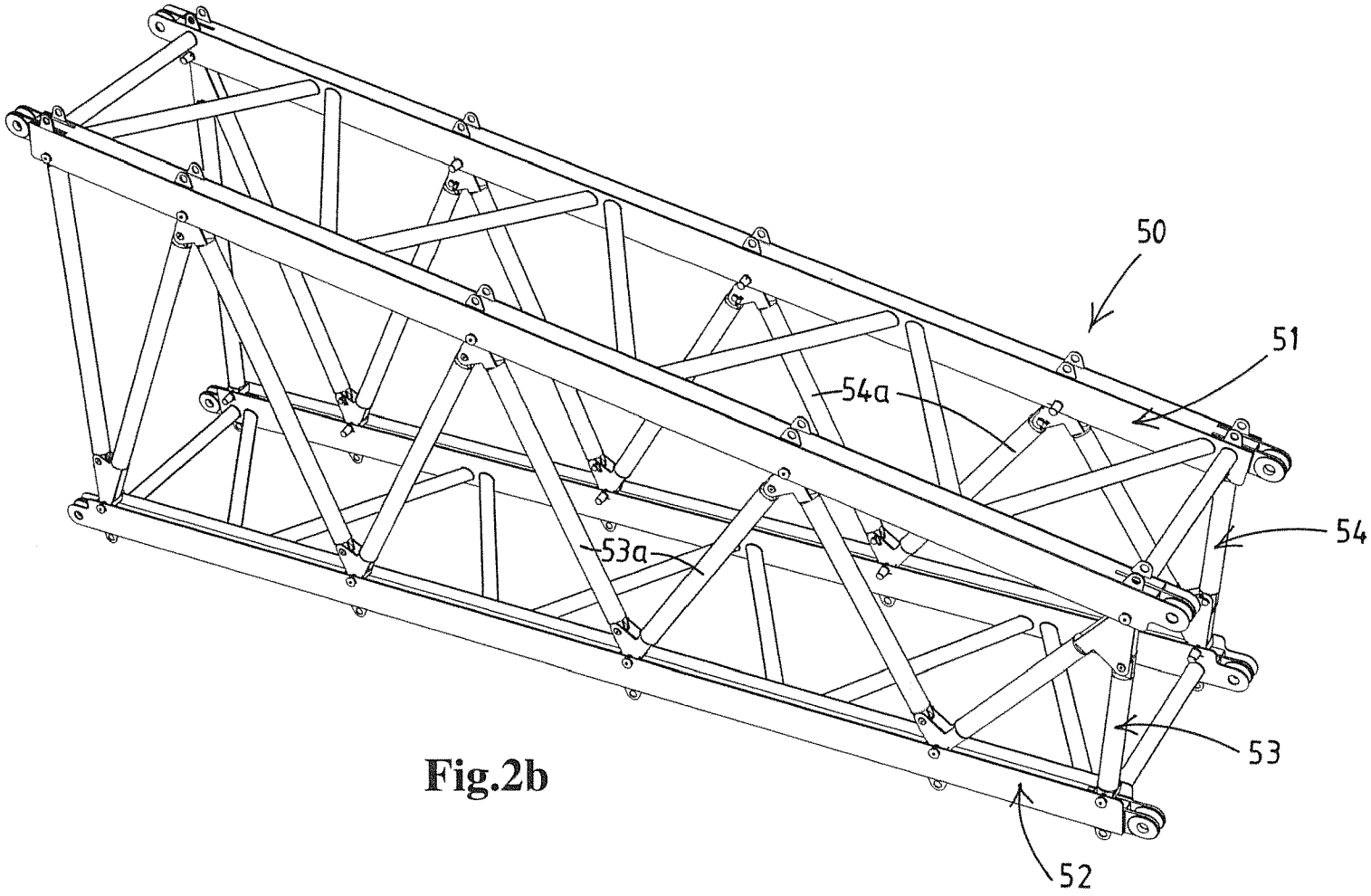
Figure 2C:
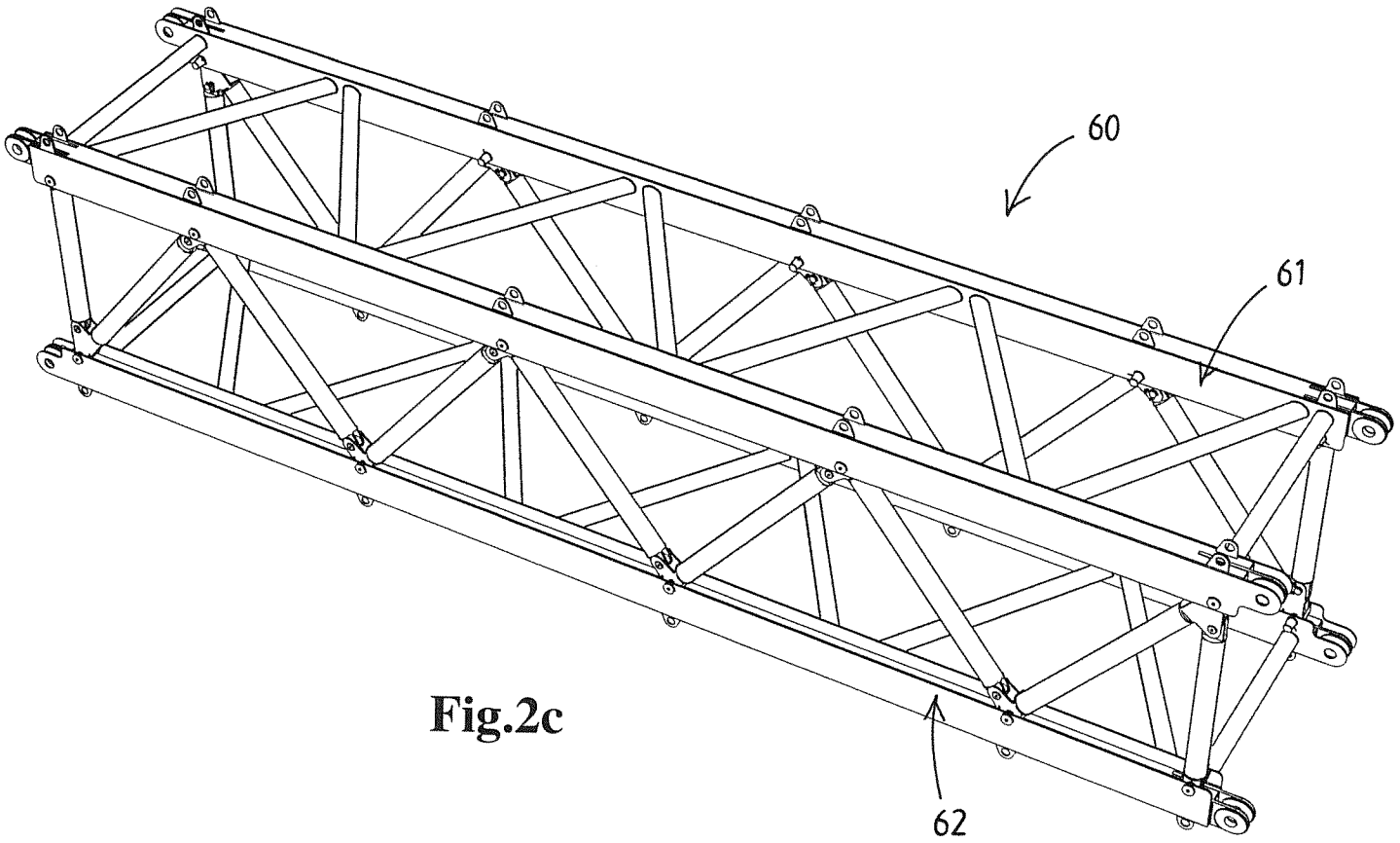
Figure 3A:
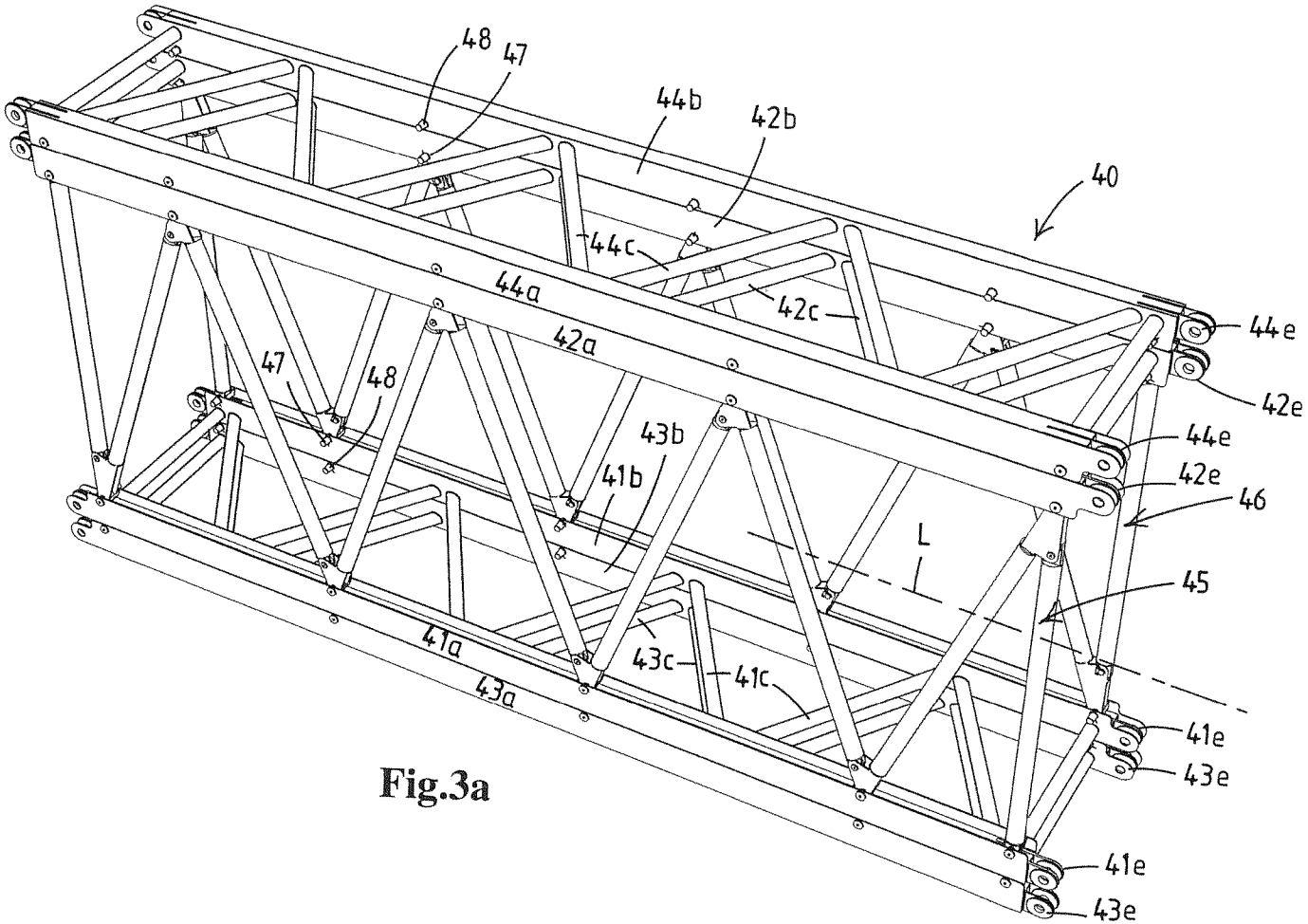
Figure 3B:
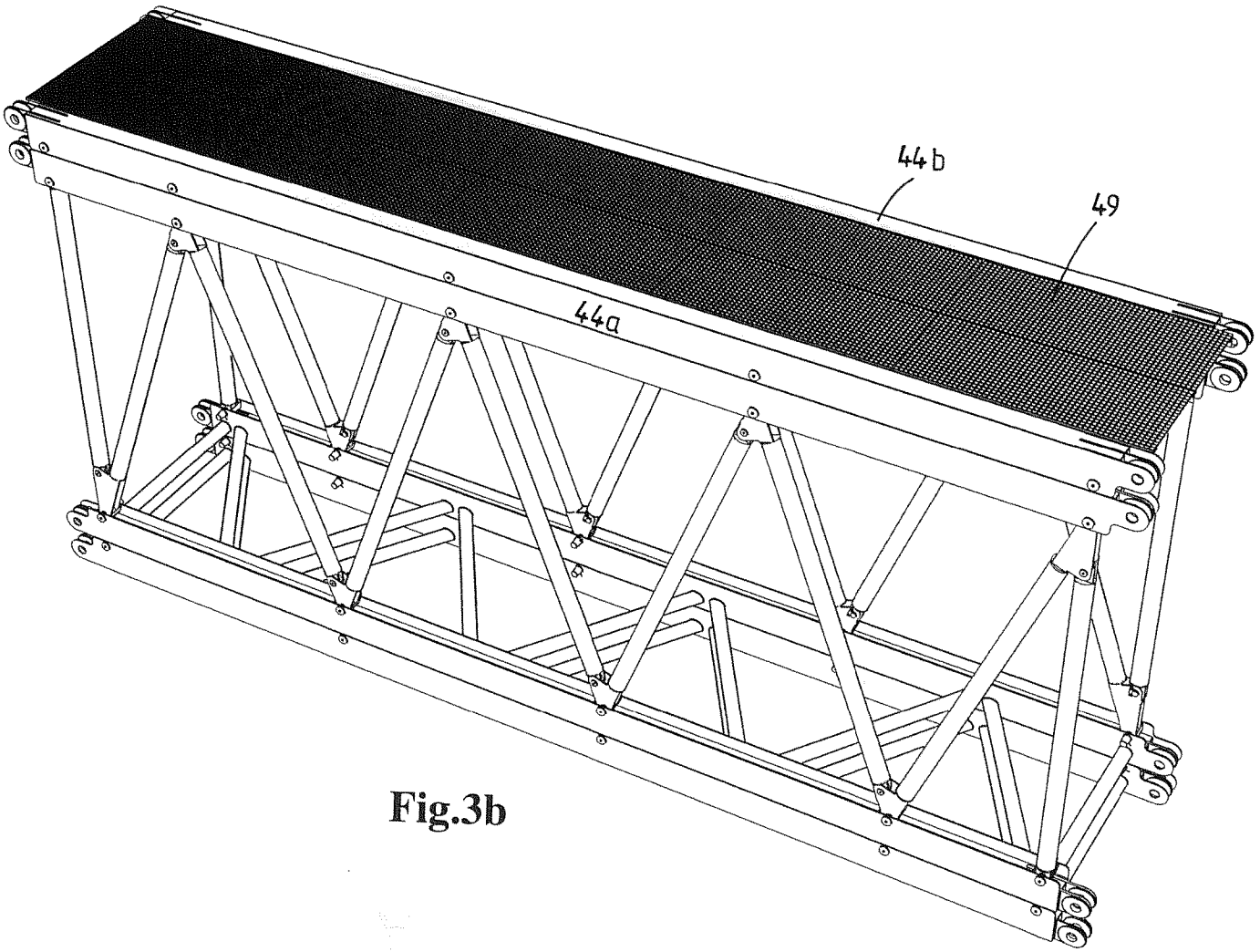
Figure 4A:
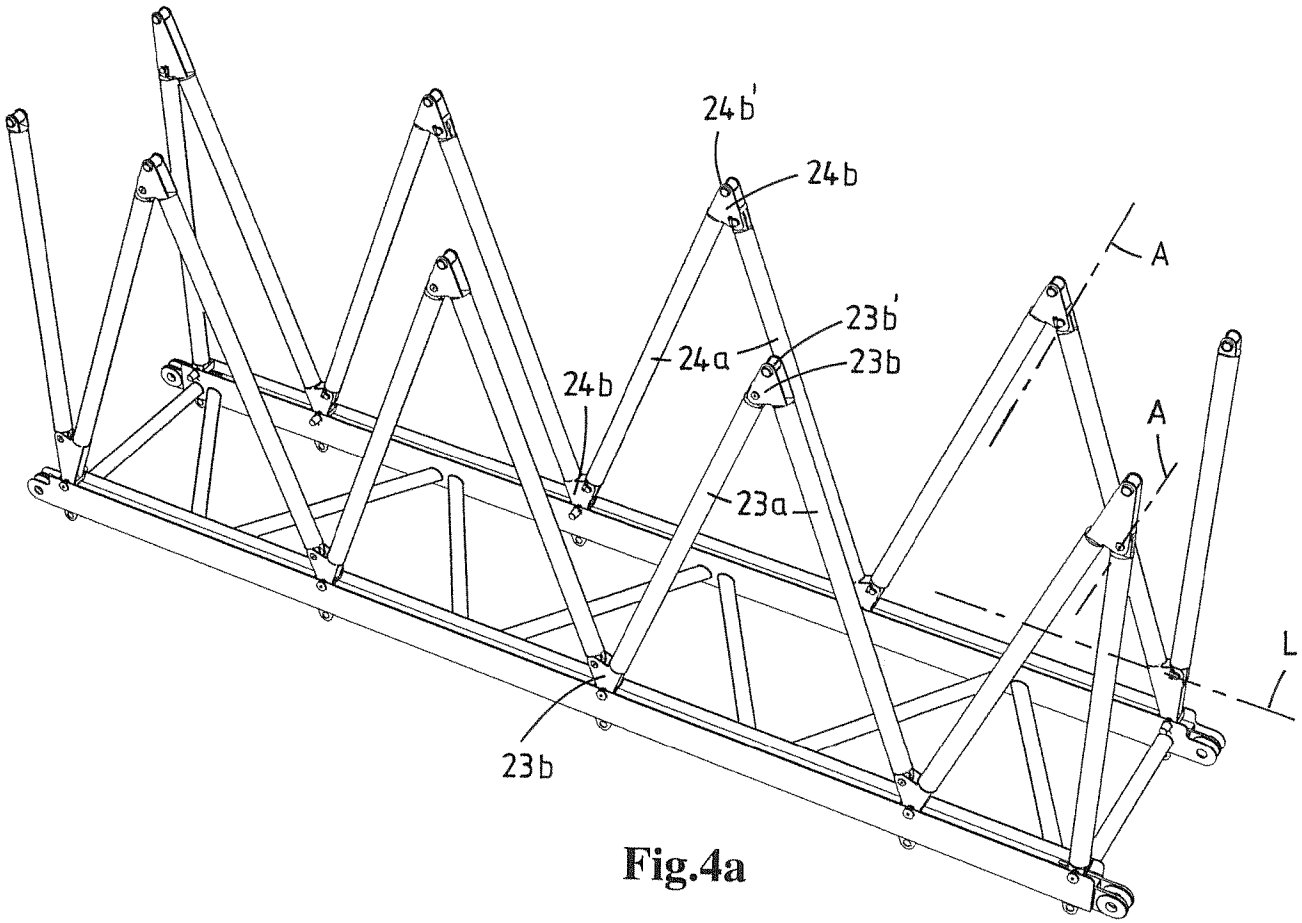
Figure 4B:
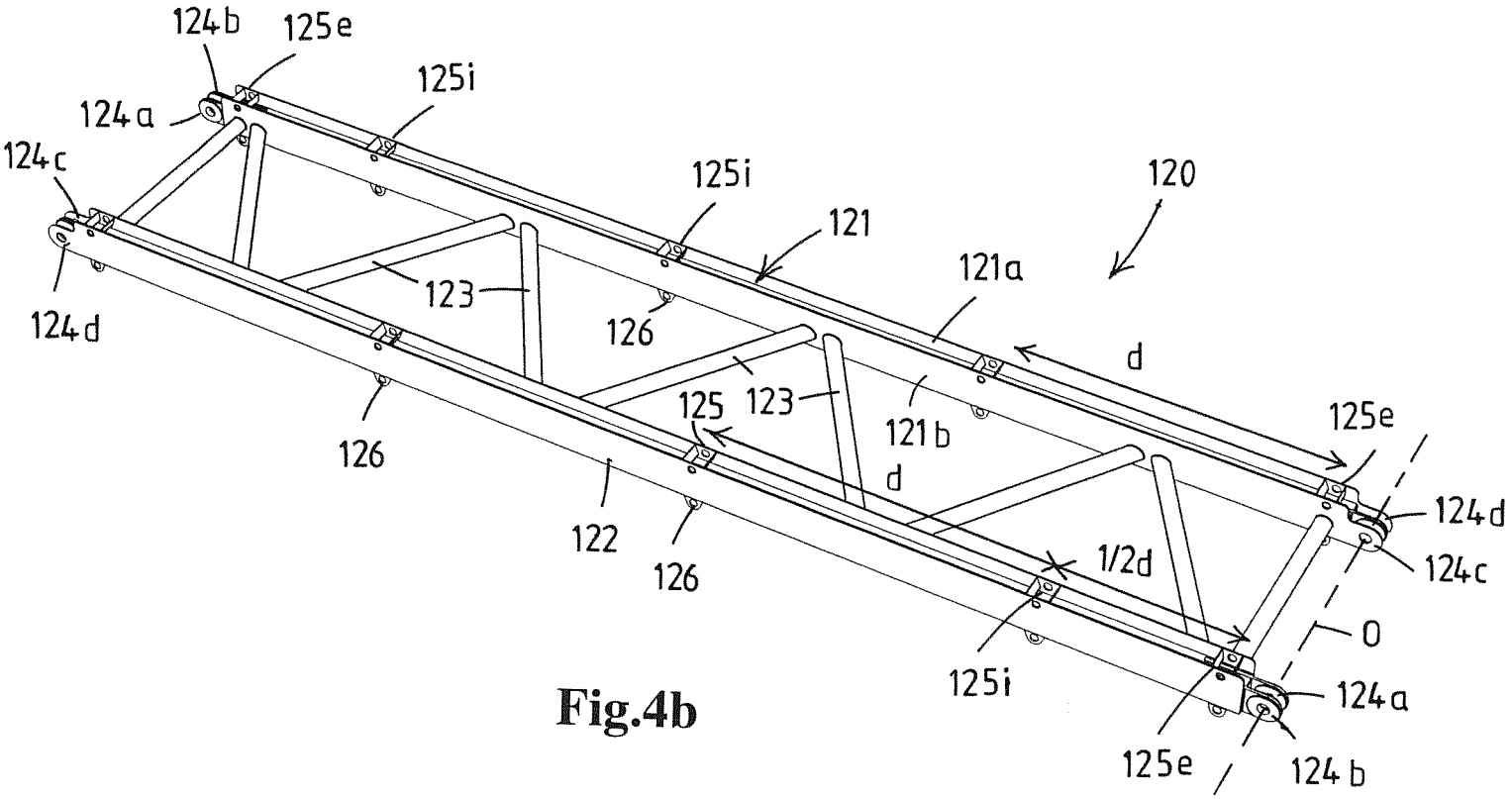
Figure 6A:
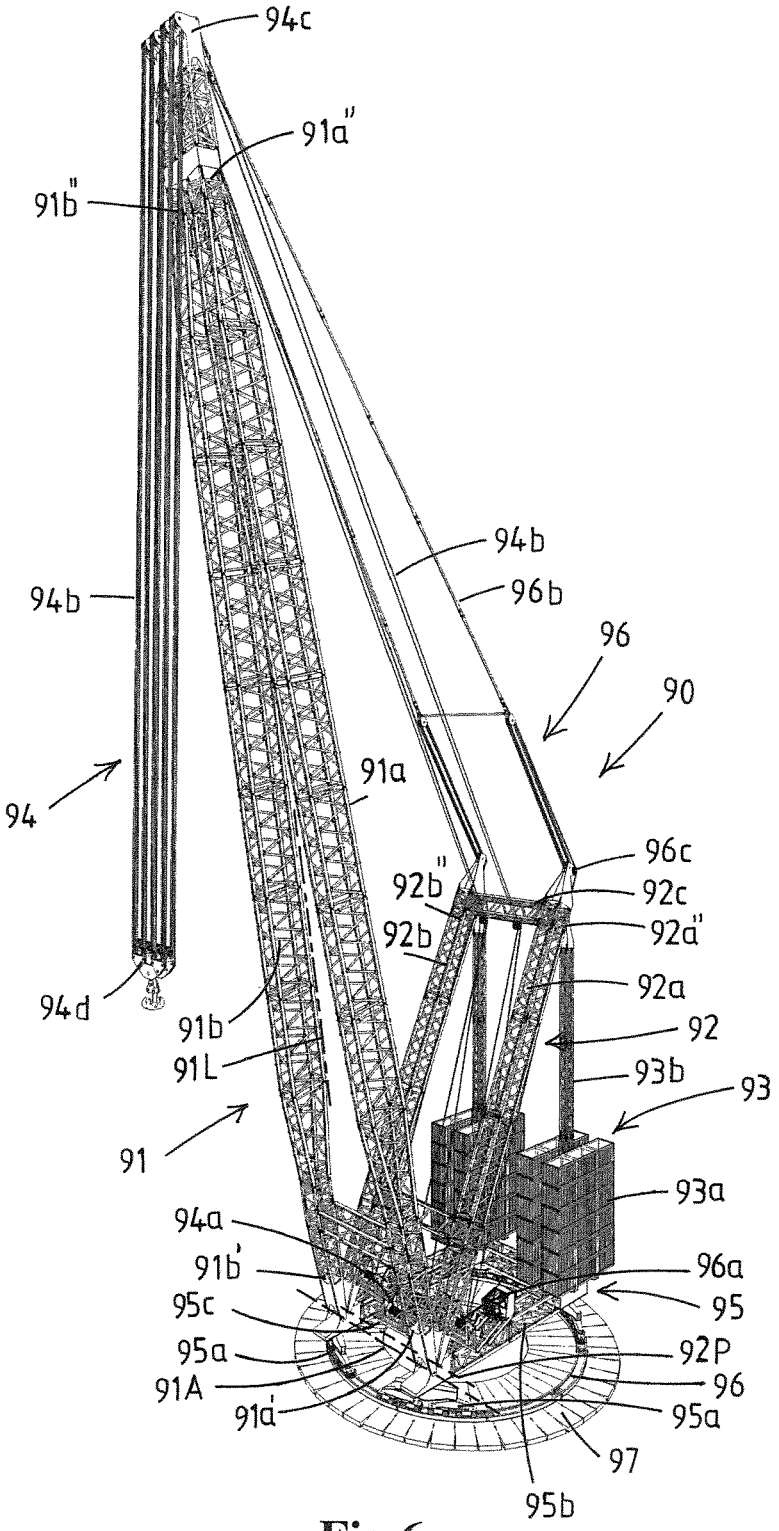
Figure 6B:
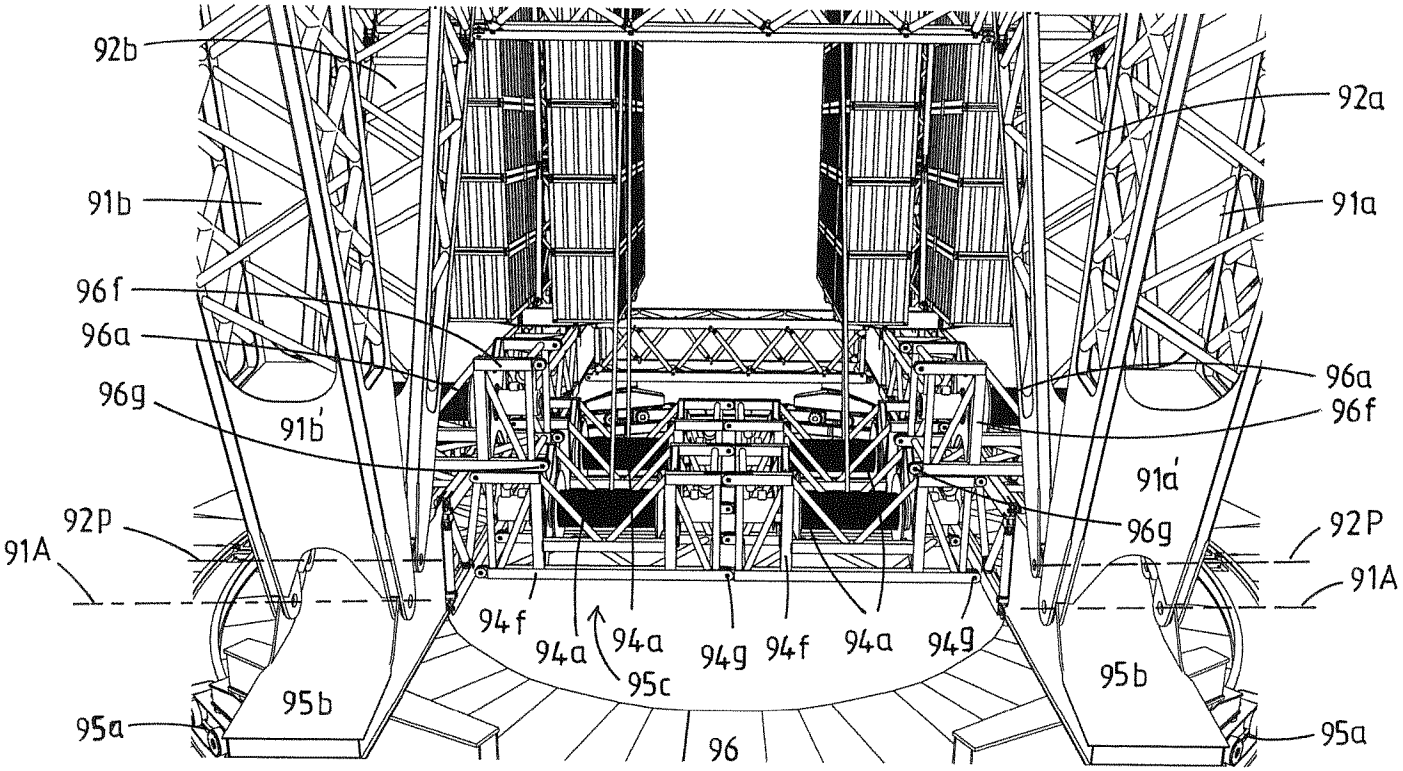
Figure 7:
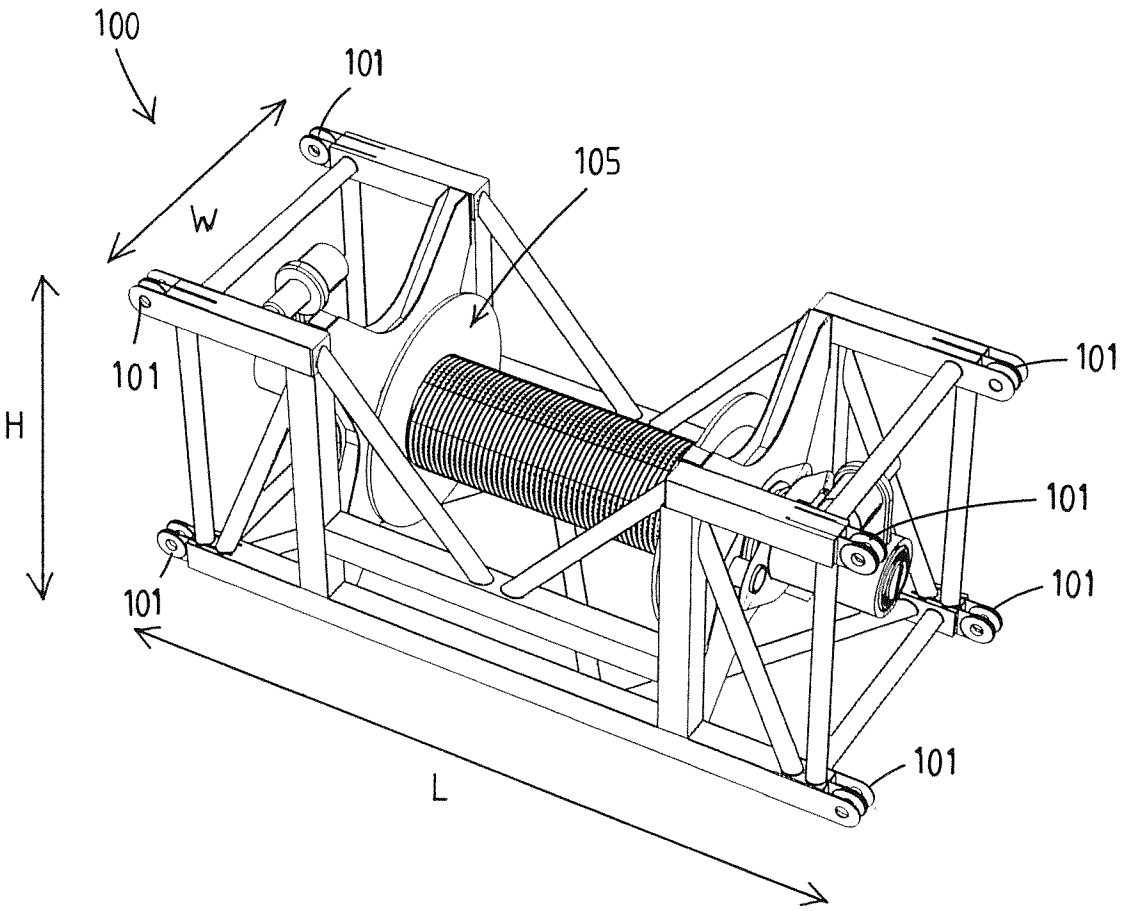

The invention will be further described in relation to the drawings, in which:

FIG. 1. shows an example of a crawler crane made of crane boom segments, possibly according to the first, second and/or third aspect of the present invention;

FIGS. 2*a*-2*c* shown different embodiments of a crane boom segment according to a first aspect of the invention;

FIGS. 3*a*-3*b* shown an embodiment of a crane boom segment according to a third aspect of the invention;

FIG. 4*a* shows an embodiment of part of a crane boom segment according to a first aspect of the invention;

FIG. 4*b* shows an embodiment of a planar latticed truss according to the invention;

FIGS. 5*a*-5*d* show an embodiment of a crane boom segment according to a second aspect of the invention;

FIGS. 6*a* and 6*b* show an embodiment of a modular crane comprising a crane boom made of crane boom segments, possibly according to the first, second and/or third aspect of the present invention, and further comprising a modular base frame comprising multiple winch base frames according to the fourth aspect of the invention;

FIG. 7 shows an example of a winch base frame according to the fourth aspect of the invention.

In FIG. 1 a crawler crane 1 is shown, designed for lifting loads of several hundred metric tons. The crane 1 as shown is a self-propelled crane and has a travelling base structure 2 which allows for travel of said crane over a surface 9. In many cases said surface will be the ground, possibly reinforced by a suitable foundation, but it is also envisaged that the crane is used on a large pontoon or the like.

A revolving superstructure 3 is mounted on said base structure 2, so that the superstructure 3 can rotate about a vertical revolving axis A with respect to the base structure 2.

The crane 1 further has a boom 4 and a backmast 5. One end 4*e* of the boom is hinged to the superstructure 3 so that the boom 4 pivots about horizontal pivot axis 6. The backmast 5 is also hinged to the superstructure 3 about a horizontal pivot axis 7. Furthermore a fly jib arrangement 8 is provided, including jib 8*a* and stay beams 8*b*, 8*c* which are all pivotably connected to the top of the boom 4.

Possibly, the boom 4 has an A-frame design, with two elongated boom sections separately connected to the superstructure and merging towards each other near the top of the boom 4. Possibly, the backmast 5 has an inverted Y-frame design with two lower backmast sections pivoted to the superstructure 3 and merging into a single section.

In the shown embodiment of the crane 1 the boom 4, the backmast 5, the jib 8*a* and stay beams 8*b*, 8*c* are composed of segments to allow for easy transport of the entire crane from one construction site to the next. In particular various crane boom segments 4*a* and backmast segments 5*a* are indicated. Preferably, some or all of the segments are embodied as crane boom segments according to the present invention.

A main load hoisting device is associated with the boom 4 for hoisting a load. In FIG. 1*a* hoisting cable 11 is shown, extending between a crane hook 13 and a main load-hoisting winch 12, which in the shown embodiment is mounted on the revolving superstructure 3.

Furthermore, in the embodiment of FIG. 1, a superstructure ballast 15 is provided, here composed of a stack of steel ballast plates. The rear end of the superstructure 3 is adapted for supporting said superstructure ballast 15 thereon.

The crane 1 further has a superlift ballast 16 and an associated connection 17 serving to connect said superlift ballast 16 to the backmast 5 while the superlift ballast 16 is resting on the surface 9 (as in FIG. 1) and/or suspended from said backmast 5 above said surface.

In this crane 1 of FIG. 1 the base structure 2 is designed as crawler assembly comprising tracks. Other designs are also envisaged such as wheeled carriage assemblies (for smaller cranes) or skid arrangements and the like.

In FIGS. 2*a*-2*c* the operational configuration of different embodiments of respective crane boom segments 20, 50, 60 according to a first aspect of the invention are shown in its entirety.

Crane boom segment 20 as shown in FIG. 2*a* will be explained below in detail, the crane boom segments shown in FIGS. 2*b* and 2*c* are of essentially the same configuration and will not be explained in detail. All three crane boom segments have a substantially rectangular cross section, are hollow on the inside and comprise a longitudinal axis L. From the drawings it can be discerned that the cross section of crane boom segment 20 as shown in FIG. 2*a* has a larger height than width, the cross section of crane boom segment 50 is variable as the crane boom segment 50 is tapering, and the cross section of crane boom segment 60 is essentially square.

The components of crane boom segment 20 are shown in detail in FIGS. 4*a* and 4*b*, and will be discussed in more detail in relation to these drawings. The crane boom segment 20 of FIG. 2*a* comprises a first planar latticed truss 21 and second planar latticed truss 22, which in the shown operational configuration are provided at opposite sides of the longitudinal axis L of the crane boom segment. Planar latticed truss 21 is provided with two chords 21*a*, 21*b*, between which permanent lacing elements 21*c* extend, and planar latticed truss 22 is provided with two chords 22*a*, 22*b*, between which permanent lacing elements 22*c* extend. Both chords of each planar latticed truss comprise segment connection parts 26 at their head ends allowing crane boom segments to be connected to each other in series, as will be explained in detail in relation to FIG. 4*a*. The planar latticed trusses 21 and 22 of this embodiment are embodied identical; such a planar latticed truss 120 is shown in detail in FIG. 4*b*, and described below in relation to this drawing.

The crane boom segment 20 further comprises a first lattice web 23 and a second lattice web 24. In the shown operational configuration first lattice web 23 is connected to chord 21*a* of the first planar latticed truss 21 and chord 22*a* of the second planar latticed truss 22, and second lattice web 24 is connected to chord 21*b* of the first planar latticed truss 21 and chord 22*b* of the second planar latticed truss 22.

In FIG. 4*a*, the crane boom segment is shown not yet in the operational configuration, prior to the connection of the lattice webs 23, 24 to the first planar latticed truss 21.

The first and second lattice webs 23, 24, shown in FIGS. 2*a* and 4*a* are embodied according to the first aspect of the invention as accordion-type lattice webs, each composed of multiple straight elements 23*a*, 24*a* that are pivotably interconnected in series by hinges 23*b*, 24*b*. In FIGS. 2*a* and 4*a* the lattice webs 23, 24 are in their operational configuration, wherein the interconnected straight elements 23*a*, 24*a* have been pivoted open to form V-shaped pairs of straight elements, forming triangular units. The hinges 23*b*, 24*b* each allow the straight elements 23*a*, 24*a* to be folded to a transport configuration in which the straight elements 23*a*, 24*a* are essentially parallel to each other, according to the first aspect of the invention. Hence, instead of transporting a 'folded out' lattice web, a 'folded in' accordion of parallel straight elements and hinges is to be transported, having a significant smaller volume than the folded out lattice web. This is in particular advantageous when crane boom segments having an increased height for improved strength are desired: the accordion-type lattice web allows the lattice web to have a height exceeding that of a transport container, while still being able to be transported in such a transport container.

In an embodiment, the hinges are configured such that they prohibit the straight elements from pivoting open further than in the operational configuration. This is advantageous during installation: on location, the folded-in accordion-type lattice webs need to be unfolded, and subsequently connected to the chords. In view of the dimensions and weight of the lattice webs this unfolding is in practice frequently carried out by a forklift or the like. It is advantageous to configure the hinges such that they prohibit the straight elements from pivoting open further than in the operational configuration, as a result of which the unfolding operation automatically results in a correct degree of folding out.

As indicated above, the crane boom segment 50 shown in FIG. 2*b* is tapering. First and second lattice webs 53, 54 of the crane boom segment 50 as shown in FIG. 2*b* comprise straight elements 53*a*, 54*a* of increasing length, seen in the direction in which the crane boom segment tapers out, to provide a crane boom segment which tapers out in the operational configuration. The planar latticed trusses 51, 52 of the shown embodiment are identical to planar latticed trusses 21, 22 of FIG. 2*a*, and also to the planar latticed trusses 61, 62 of the crane boom segment 60 of FIG. 2*c*. This is advantageous as this allows the configuration of a crane boom comprising tapered crane boom segments as shown in FIG. 2*b*, square crane boom segments as shown in FIG. 2*c* and having a rectangular cross-section as shown in FIG. 2*a*, all with the same planar latticed trusses. This reduces the number of different components, while maintaining a freedom in design options.

It is not shown, but likewise conceivable that the crane boom segments are tapering in two dimensions, hence, not only the first and second lattice webs being tapering as shown in FIG. 2*b*, but also the planar latticed trusses being provided tapering.

The hinges 23*a*, 23*b* comprise a horizontal pivot axis A, indicated for two hinges in FIG. 4*a*. Pivot axis A is perpendicular to the longitudinal axis L of the crane boom segment. The hinges comprise a fastener member, 23*b*', 24*b*', which are here embodied as a portion of the hinge which is provided with a hole. The chords 21, 22, are provided with complementary fastener members to allow the accordion-type lattice webs 23, 24 to be connected to the chords. The connection between the lattice webs 23, 24 and the chords 21, 22 is achieved here by pins 25*a*, 25*b*, 25*c*, 25*d*, which are provided fastener members 23*b*', 24*b*' and the complementary chord fastener members. Because of the connection between the fastener members 23*b*', 24*b*' of the hinges of the lattice webs and the complementary fastener members on the chords, these individual members cannot be discerned in the operational configuration as shown in FIG. 2*a*. The complementary chord fastener members are embodied as pin-receiving holes 125 provided in the chord, as shown in FIG. 4*b* and described in detail below.

In FIG. 4*b*, a planar latticed truss 120 is shown in detail. Here two chords 121 and 122 can be discerned, which essentially are longitudinal beams formed by parallel interconnected plates 121*a*, 121*b*, defining a rectangular cross section. Between the chords 121 and 122, permanent lacing elements 123 extend. The lacing elements are embodied as rods, which are at the ends thereof permanently fixed to the chords. Here, the lacing elements are embodied as circular rods, forming triangular units between the chords 121, 122.

Both chords 121, 122 comprise segment connection parts 124 at their head ends, allowing crane boom segments to be connected to each other in series. In the shown embodiment, the connection parts 124 are embodied as a set of plates 124*a*, 124*b*, 124*c*, 124*d*, protruding at the head ends in the longitudinal direction of the chords, which are each provided with bores which are provided such that they define a connection axis O, perpendicular to the chords, in the plane of the planar latticed truss. In these bores a connection pin can be received for providing the connection between the crane boom segments. In the shown embodiment, the set of plates 124*a*, 124*b*, at one head end of a chord is offset in the direction of the connection axis O, allowing the bores of a crane boom segment to line up with the bores in the set of plates 124*c*, 124*d*, of an adjacent crane boom segment to be connected to these.

The planar latticed truss 120 is suitable to be used in a crane boom segment according to the first embodiment of the present invention. To this end, the chords 121, 122 are provided with complementary fastener members 125, allowing fastener members of the hinges of an accordion-type lattice web to be connected to the chords 121, 122.

In the shown embodiment, the complementary fastener members 125 are embodied as pin-receiving holes provided in the plates 121*a*, 121*b* of a chord. In the shown embodiment, as is preferred, each of the chords 121, 122 of a planar latticed truss is provided with end complementary fastener members 125*e* at their ends and with multiple intermediate complementary fastener members 125*i* between said end complementary fastener members 125*e*, all intermediate complementary fastener members and one of the end complementary fastener members having the same mutual distance d, and the distance between the other end complementary fastener member and an adjacent intermediate complementary fastener member being half that distance ½ d, and wherein at the end of a planar lattice truss one chord ends with the mutual distance between the end complementary fastener member and the adjacent intermediate complementary fastener member being half that distance ½ d, and the other chord ends with the mutual distance between the end complementary fastener member and the adjacent intermediate complementary fastener member being the distance d. An effect of this configuration of complementary fastener members is that both planar latticed trusses of a crane boom segment can be embodied identically while allowing the connection of identical first and second lattice webs. This reduction of the number of different components of a crane boom segment is highly advantageous on-site during assembly.

In the shown embodiment, the complementary fastener members 125 on a chord are provided at a distance from the portion of the chord from which the permanent lacing elements 123 extend. This is advantageous for the strength of the boom segment.

It is noted here that the planar latticed truss 120 is also suitable to be used in a crane boom segment according to the third embodiment of the present invention. To this end, the chords 121, 122 are provided with mating chord fastener members 125, 126, to connect another planar latticed truss directly onto of the planar latticed truss 120 by providing a connection between the chord fastener members 125, 126.

In the shown embodiment, the members 125 can thus advantageously be used as complementary fastener members 125, allowing fastener members of the hinges of an accordion-type lattice web to be connected to the chords 121, 122, according to the first aspect of the invention, and alternatively, the same members 125 can be used as chord fastener members 125 to connect another planar latticed truss directly onto of the planar latticed truss 120 by providing a connection between the chord fastener members 125, 126.

Mating chord fastener members 126 (according to the third aspect of the invention) are provided as lugs, protruding from the chords 121, 122, opposite to the chord fastener members 125 with respect to the plane of the planar lattice truss 120. Hence, the mating chord fastener members are also provided at the ends of the chords and between the ends, similar to the configuration of the complementary fastener members according to a preferred embodiment of the first aspect of the invention. The lugs 126 comprise an opening which is adapted to align with the pin-receiving holes of the chord fastener members 125 in the operation configuration, when another planar latticed truss is connected directly onto of the planar latticed truss 120, allowing a pin to provide a connection between the mating chord fastener members 125, 126.

The operational configuration of a crane boom segment 40 according to a third aspect of the invention is shown in FIGS. 3*a* and 3*b*. This crane boom segment 40 comprises four planar latticed trusses 41, 42, 43, 44, and two lattice webs 45, 46, which are in the shown embodied are configured according to the first aspect of the invention.

Each planar latticed truss is embodied as the planar latticed truss 120 shown in detail in FIG. 4*b*. In particular, planar latticed truss 41 comprises two chords 41*a*, 41*b* between which permanent lacing elements 41*c* extend, planar latticed truss 42 comprises two chords 42*a*, 42*b* between which permanent lacing elements 42*c* extend, planar latticed truss 43 comprises two chords 43*a*, 43*b* between which permanent lacing elements 43*c* extend and planar latticed truss 44 comprises two chords 44*a*, 44*b* between which permanent lacing elements 44*c* extend. Segment connection parts 41*e*, 42*e*, 43*e*, 44*e* are provided at their head ends allowing crane boom segments to be connected to each other in series.

Members on the chords 41*a*, 41*b*, 44*a*, 44*b*, which are similar to members 125 as shown in FIG. 4*b* are used as complementary fastener members connecting one accordion-type lattice web 45 to the chord 41*a* of the first planar latticed truss 41 and the chord 42*a* of the second planar latticed truss 42. The other accordion-type lattice web 46 is connected to the chord 41*b* of the first planar latticed truss 41 and chord 42*b* of the second planar latticed truss 42. In particular is the connection between the lattice webs and the chords achieved by pins 47 provided in the chord fastener members, which are embodied as pin-receiving holes 125 provided in the plates of a chord, as shown in FIG. 4*b*. Because of the connection between the fastener members of the hinges of the lattice webs and the complementary fastener members on the chords, these individual members cannot be discerned in the operation configuration as shown in FIG. 3*a*.

According to the third aspect of the invention, the crane boom segment comprises a third planar latticed truss 43 and, as is preferred, also a fourth planar latticed truss 44. Each of the chords 41*a*, 41*b* of the first planar latticed truss 41 and each of the chords 43*a*, 43*b* of the third planar latticed truss 43; and each of the chords 42*a*, 42*b* of the second planar latticed truss 42 and each of the chords 44*a*, 44*b* of the fourth planar latticed truss 44 are provided with mating chord fastener members 125, 126. In the shown operational configuration the third planar lattice truss 43 is connected directly onto of the first planar latticed truss 41 by providing a connection between the mating chord fastener members. In the shown embodiment, the connection is provided by connection pins 48 provided in the mating chord fastener members, which are embodied as pin-receiving holes 125 provided in the plates of a chord, as shown in FIG. 4*b*, and mating chord fastener members 126 embodied as lugs, protruding from the chords, as shown in FIG. 4*b*. Because of the connection between the mating chord fastener members, these individual members cannot be discerned in the operation configuration as shown in FIG. 3*a*.

In FIG. 3*b*, the fourth planar latticed truss 44 is provided with an optional cover plate 49, which in the shown embodiment is provided between the chords 44*a*, 44*b* of the planar latticed truss 44, onto of the permanent lacing elements, which are consequently no longer visible. The cover plate 49 may e.g. be provided to contribute to the strength of the crane boom segment, or alternatively to add functionality, such as the ability to be able to walk on a crane boom segment.

Figure 5A:
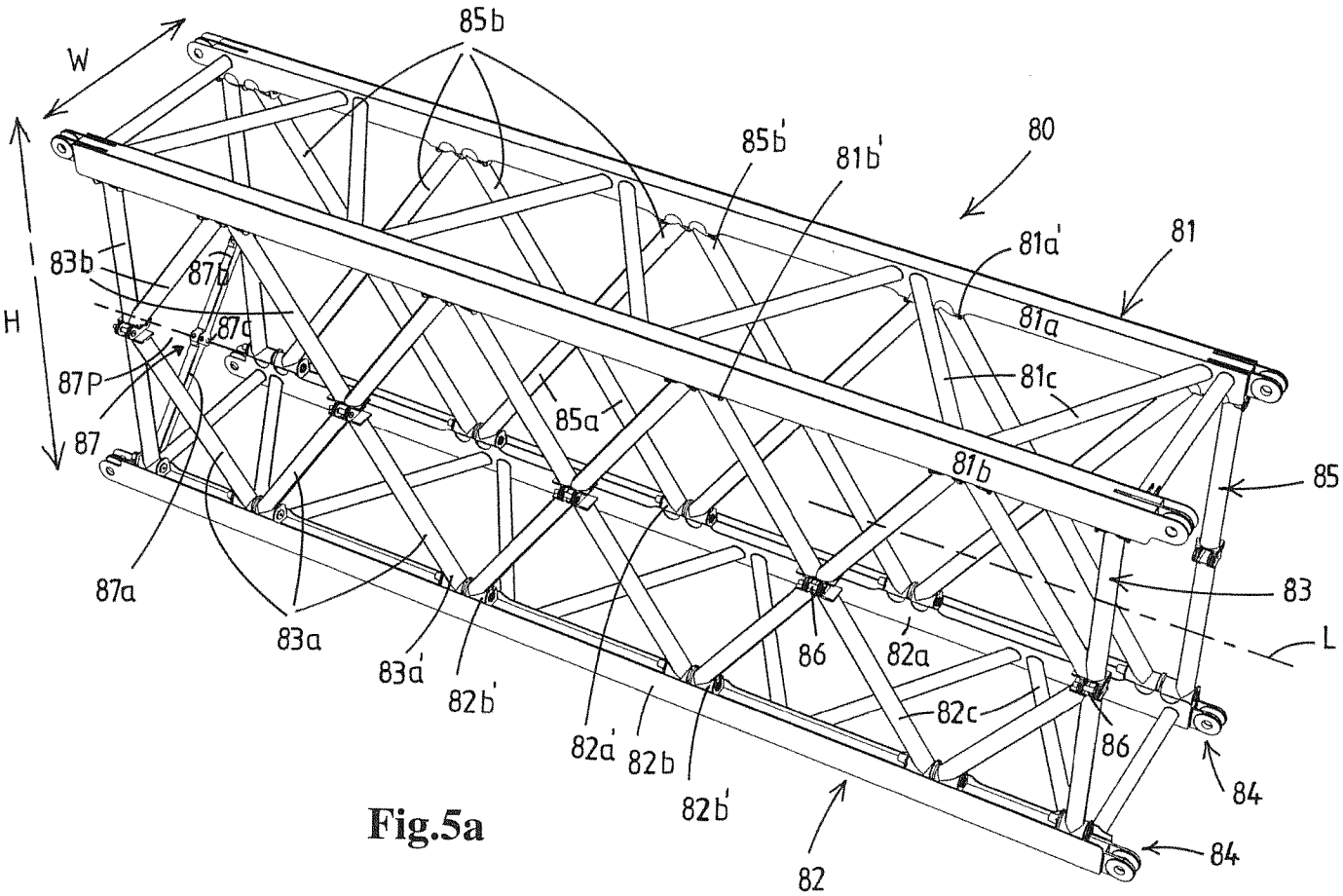
Figure 5B:
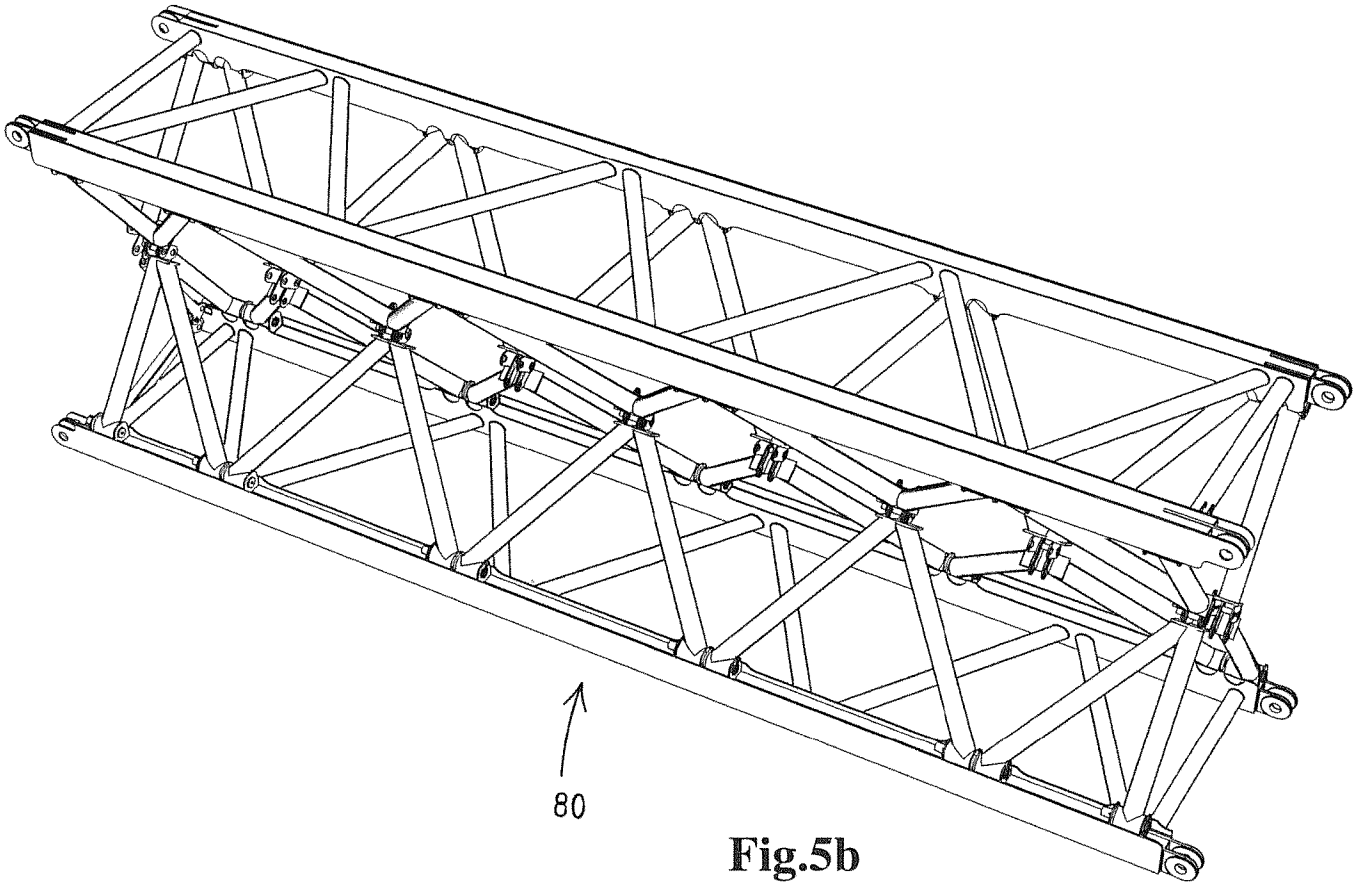
Figure 5C:
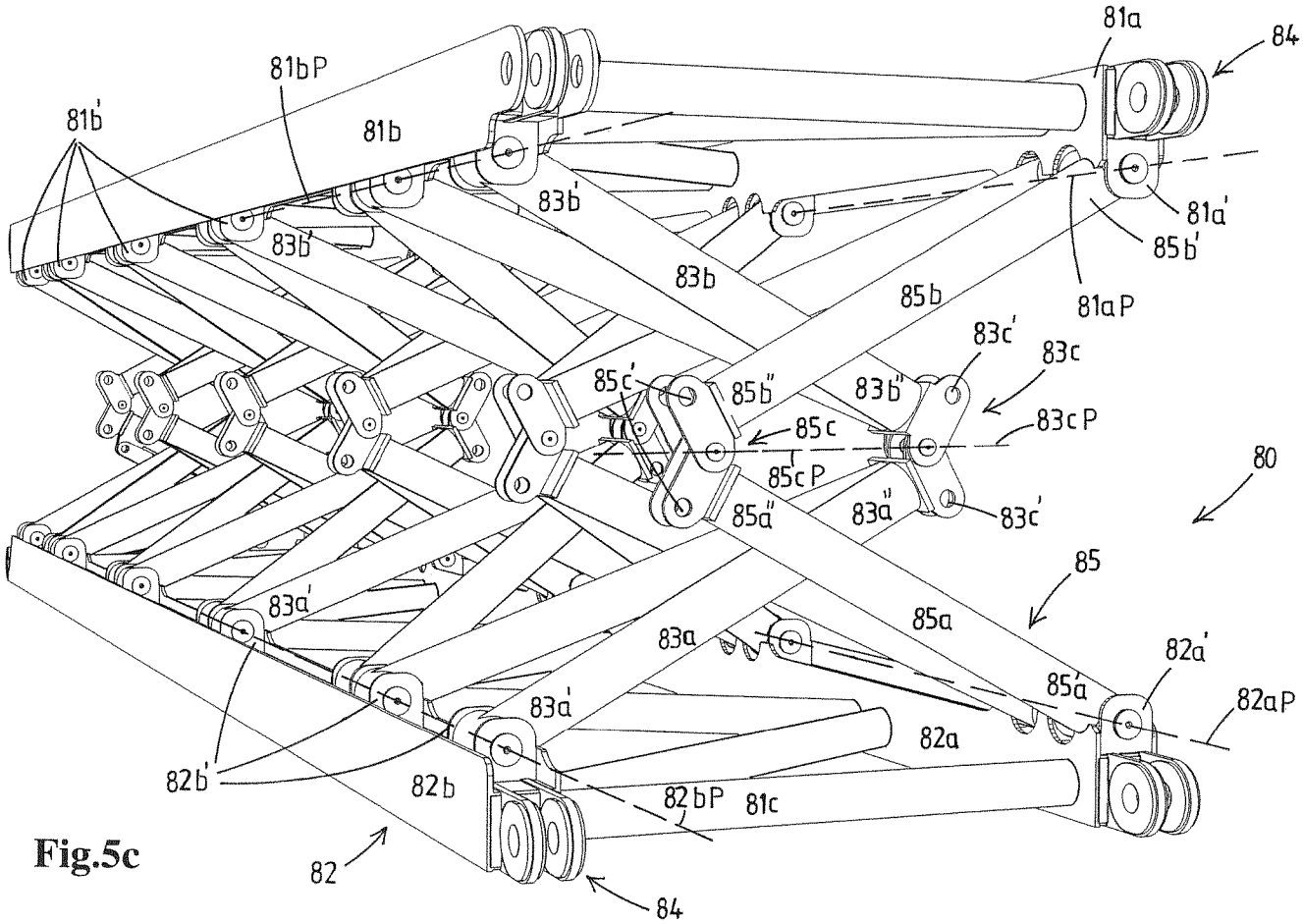
Figure 5D:
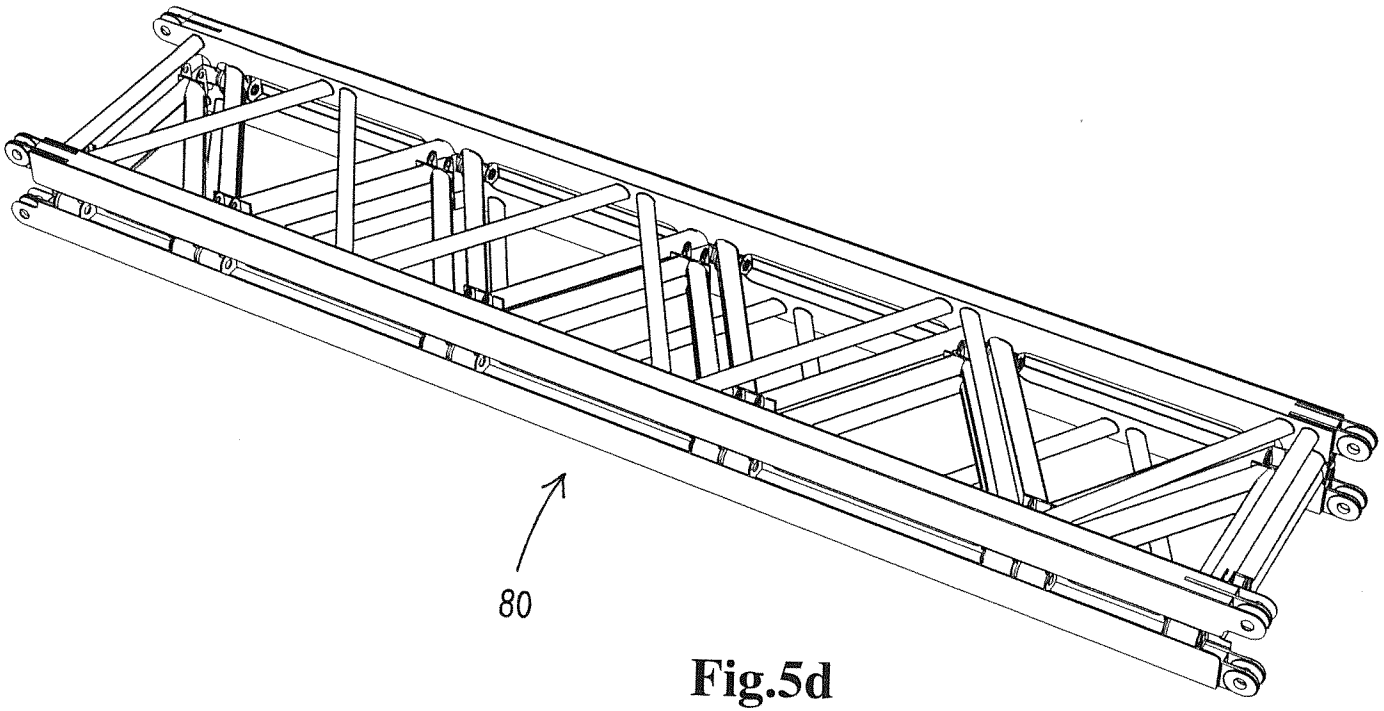

In FIGS. 5*a*-5*d* an embodiment of a crane boom segment 80 according to a second aspect of the invention is shown. In FIG. 5*d*, the crane boom segment 80 is shown in the transport configuration, while in FIG. 5*a* the crane boom segment 80 is in the operational configuration, in which it has a substantially rectangular cross section and a longitudinal axis L. In particular, according to this second aspect of the invention, in the operational configuration of FIG. 5*a* the height of H first and second lattice webs 83, 85 exceeds the width W of first and second planar latticed trusses 81, 82.

The crane boom segment 80 comprises a first planar latticed truss 81 and a second planar latticed truss 82. Each truss comprises two chords 81*a*, 81*b* and 82*a*, 82*b*, between which permanent lacing elements 81*c*, 82*c* extend. All chords 81*a*, 81*b*, 82*a*, 82*b* comprise segment connection parts 84 at their head ends, allowing crane boom segments to be connected to each other in series. The segment connection parts 84 are embodied similar to the connection parts 124 shown in FIG. 4*b*, and have already been described in relation to this drawing. In the operational configuration of FIG. 5*a*, the first and second planar latticed trusses 81, 82 are provided at opposite sides of the longitudinal axis L of the crane boom segment 80.

Crane boom segment 80 further comprises a first and second lattice web 83, 85, which are connected to the chords both in the operational configuration of FIG. 5*a* and also in the transport configuration of FIG. 5*d*, and in the configurations therebetween shown in FIGS. 5*b* and 5*c*. In particular, first lattice web 83 is connected to the chords 81*b*, 82*b*, and second lattice web 85 is connected to the chords 81*a*, 82*a*.

According to the second aspect of the present invention, each of the lattice webs 83, 85 is composed of multiple straight rods 83*a*, 83*b*, 85*a*, 85*b* forming triangular units. Each straight rod is pivotably connected at one end via a chord hinge to a chord about a pivot axis parallel to the chord. In particular,

- straight rods 83*a* are pivotably connected at one end 83*a*' via a chord hinge 82*b*' to chord 82*b* about a pivot axis 82*b*P;
- straight rods 83*b* are pivotably connected at one end 83*b*' via a chord hinge 81*b*' to chord 81*b* about a pivot axis 81*b*P;
- straight rods 85*a* are pivotably connected at one end 85*a*' via a chord hinge 82*a*' to chord 82*a* about a pivot axis 82*a*P;
- straight rods 85*b* are pivotably connected at one end 85*b*' via a chord hinge 81*a*' to chord 81*a* about a pivot axis 81*a*P.

It is noted that the chord hinge may be embodied such that a single straight rod is connected to it, such as the chord hinges at the end of some of the chords of the embodiment shown in FIG. 5, but alternatively the chord hinges may also be embodied so as to connect two straight rods to the chord, such as the chord hinges provided between the ends of the chords shown in FIGS. 5*a*-5*d*.

According to the second aspect of the invention, the other end of the straight rods is pivotably connected to another straight rod via a central hinge about a parallel pivot axis. In particular,

- straight rods 83*a* are pivotably connected at the other end 83*a*" via a central hinge 83*c* to the end 83*b*" of straight rod 83*b*, about a pivot axis 83*c*P;
- straight rods 85*a* are pivotably connected at the other end 85*a*" via a central hinge 85*c* to the end 85*b*" of straight rod 85*b*, about a pivot axis 85*c*P.

In particular, in the embodiment shown, the central hinges 83*d*, 85*c* connect two straight rods connected to the same chord to two other straight rods connected to the other cord.

The central hinges 83*c*, 85*c* of the first and second lattice webs are offset, allowing the central hinges of a lattice web to move away from the plane of that lattice web in the operational configuration, to be folded to a transport configuration whereby the straight rods of the first lattice web and the straight rods of the second lattice web nest into each other.

This configuration of the lattice webs 83, 85 allows the lattice web to be foldable from the operational configuration shown in FIG. 5*a* to the transport configuration of FIG. 5*d*, via the configurations shown in FIGS. 5*b* and 5*c*. Because the central hinges 83*c* and 85*c* are offset, the central hinges 83*c* of the first lattice web 83 are allowed to move away from the plane of the lattice web 83, towards the opposed side of the crane boom segment. In the transport configuration of FIG. 5*d*, the straight rods 83*a*, 83*b* of the first lattice web 83 and the straight rods 85*a*, 85*b* of the second lattice web nest into each other. This 'nesting' principle is in particular visible in FIGS. 5*b* and 5*c*. In addition, in the shown transport configuration of this embodiment of the invention, the central hinges of one lattice web lie essentially between the chord hinges of the other lattice web. This is in particular visible in FIG. 5*d*.

In the shown embodiment, as is advantageous, the central hinges 83*c*, 85*c* are provided with locking members to be able to lock the lattice webs in the operational configuration. In FIG. 5*c*, it is visible that in the shown embodiment, the locking members are embodied as bores 83*c*', 85*c*', provided in opposed parts of the central hinges 83*c*, 85*c*. In FIG. 5*a*, it is visible that locking pins 86 are provided in the bores 83*c*', 85*c*' to lock the lattice webs and prevent them from undesired folding to the transport configuration.

In the embodiment shown in FIG. 5*a*, a fixation member 87 is shown, which is advantageously provided. Fixation member 87 comprises two rods 87*a* and 87*b*, the ends of which are connected to the first and second lattice web 83 and 85, in a plane perpendicular to that of the planar latticed trusses 81 and 82, which rods 87*a* and 87*b* are connected pivotably to each other via a central fixation hinge 87*c* about a fixation pivot axis 87P which is parallel to the other pivot axes 81*a*P, 82*a*P, 81*b*P, 82*b*P and 83*c*P, and to the chords 81*a*, 81*b*, 82*a*, 82*b*, wherein the central fixation hinge 87*c* is provided with fixation members (not shown in detail) to be able to fixate the fixation member 87 in the operational configuration, and accordingly lock the lattice webs in the operational configuration. The fixation members can e.g. comprise holes forming a socket for a fixation pin.

In FIGS. 6*a* and 6*b*, an embodiment of a modular crane 90 is shown, comprising a crane boom 91 assembled from crane boom segments, possibly according to the first, second and/or third aspect of the present invention. In FIG. 6*b*, a detail of the crane 90 is shown in a perspective view.

Modular crane 90 is embodied as a ring lift crane comprising a travelling base frame 95 which allows for travel of said crane 90 over a surface. Travelling may involve a rotation, translation or a combination thereof. In the shown embodiment, the travelling base frame is provided with bogies 95*a*, adapted to travel over a ring 96 mounted on a floor 97, allowing the base frame 95 to rotate. Alternative configurations allowing the base frame to rotate are also conceivable. Yet alternatively, it is also conceivable that the travelling base is provided with tracks or wheels, allowing the modular crane to travel.

The modular crane comprises a crane boom 91 comprises two elongated boom sections 91*a* and 91*b*, each of which is assembled from crane boom segments allowing the modular crane to be transportable. One end 91*a*', 91*b*'of each boom section is hingedly connected about a substantially horizontal pivot axis 91A, to the travelling base frame 95. The other ends 91*a*", 91*b*" of the boom sections 91*a*, 91*b* merge towards each other near the top of the crane boom 91.

The modular crane further comprises a backmast 92 that is mounted pivotably to said base frame 95 about a horizontal pivot axis 92P. In the shown embodiment, the backmast 92 comprises two elongated backmast sections 92*a* and 92*b*, one end of each backmast section being hingedly connected about the pivotat axis 92P to the base frame 95. The other ends 92*a*" and 92*b*" of the backmast sections are connected to each other via a backmast connection section 92*c*.

The modular crane 90 further comprises ballast 93, here embodied as containers 93*a* connected via a lattice structure 93*b* to the upper ends 92*a*", 92*b*" of the backmast 92.

Furthermore, a main hoisting device 94 is provided, comprising a main hoisting winch 94*a*, a main hoist wire 94*b* that is guided over the crane boom via sheaves 94*c* and a hook 94*d*, connected to the main hoist wire 94*b*. Also a luffing device 96 is provided, comprising a luffing winch 96*a* and a luffing cable 96*b*, extending between the luffing winch 96*a*, the backmast 92, in particular sheaves 96*c* provided at the upper ends of the backmast sections 92*a*, 92*b*", and the crane boom 91.

The base frame as shown comprises two parallel main girders 95*b* to which the crane boom segments 91*a*, 91*b* and the backmast sections 92*a*, 92*b* are connected, and one or more cross-girders 95*c* provided therebetween. The girders 95*b*, 95*c* are assembled from girder segments. According to a preferred embodiment of the fourth aspect of the invention, one of the cross-girders 95*c* comprises two hoist winches 94*a*, mounted within hoist winch frames 94*f*, visible in FIG. 6*b*, which are connected to each other in series via connectors 94*g*.

The hoist winch frame into which a main hoisting winch 94*a* is mounted is embodied as a shipping container comprising connectors 94*g* at the corners thereof according to the fourth aspect of the invention. In FIG. 6*b*, the cross-girder 95*c* is clearly visible. The cross-girder 95*c* is composed of four interconnected hoist winch frames 94*f*, into which four main hoist winches 94*a* are mounted. The main hoist winch frames 94*f* are interconnected via connectors 94*g*, provided at the corners of the main hoist winch frames 94*f*.

In the shown embodiment, also the luffing winch 96*a* is mounted within a luffing winch frame 96*f*, embodied as a shipping container comprising connectors 96*g* at the corners thereof. In the shown embodiment, the luffing winch frame 96*f* is connected to the main girders 95*b* of the base frame. Preferably, the luffing winch frame 96*f* also forms part of the base frame, being included into the main girders 95*b* of the base frame.

An example of such a hoist winch frame 100 comprising a main hoist winch 105 is shown in detail in FIG. 7.

In FIG. 7 it is visible that the entire main hoist winch 105 fits into the container 100, in particular, the container 100 forming an 'exosceleton' about the main hoist winch 105. The container 100 is embodied as a rectangular hexahedron shipping container, comprising 8 corners. In the shown embodiment, each of the corners of the container is provided with connectors 101, allowing the hoist winch frame 100 to be connected to the girders of the base frame.

It is noted that due to the significant weight of a main hoist winch, which may be up to 28 tons including the hoist wire, the dimensions of a hoist winch frame may be smaller than other shipping containers. In particular, to be able to connect the hoist winch frame and integrate it into the base frame, the hoist winch frame preferably a cross-sectional dimension H*W that allows the connection to girder segments. On the other hand, the length L of the container 100 may be kept relatively small.

It is conceivable that a hoist winch frame, or multiple hoist winch frames connected to each other in series, together form a girder. Alternatively, the hoist winch frame(s) is/are connected to girder segments to form a girder.

The invention claimed is:

1. A crane boom segment for assembly of a crane boom by interconnection of multiple crane boom segments from a transport configuration to an operational configuration, wherein the crane boom segment has a substantially rectangular cross section and a longitudinal axis, the crane boom segment comprising:

a first and second planar latticed truss, each with two chords between which permanent lacing elements extend, wherein both chords of each planar latticed truss comprise segment connection parts at head ends thereof, allowing crane boom segments to be connected to each other in series, and wherein in the operational configuration the first and second planar latticed trusses are provided at opposite sides of the longitudinal axis of the crane boom segment; and a first and second lattice web, each lattice web connectable to one of the chords of the first planar latticed truss and one of the chords of the second planar latticed truss, wherein the first and second lattice webs are accordion-type lattice webs, each composed of multiple straight elements that are pivotably interconnected in series by hinges each having a pivot axis, wherein in the folded transport configuration the straight elements are essentially parallel to each other, and in the operational configuration the interconnected straight elements have been pivoted open to form V-shaped pairs of straight elements, wherein the hinges each comprise a fastener member and the chords are provided with complementary fastener members to allow the accordion-type lattice web in the operational configuration connected to the chords, wherein the chords of a planar latticed truss are each provided with one of said complementary fastener members at ends thereof, and with multiple intermediate complementary fastener members between said end complementary fastener members, all intermediate complementary fastener members and one of the end complementary fastener members having the same mutual distance, and the distance between the other end complementary fastener member and an adjacent intermediate complementary fastener member being half that distance, and wherein at the end of a planar lattice truss one chord ends with the mutual distance between the end complementary fastener member and the adjacent intermediate complementary fastener member being half that distance, and the other chord ends with the mutual distance between the end complementary fastener member and the adjacent intermediate complementary fastener member being the distance.

2. The crane boom segment according to claim 1, wherein the hinges prohibit the straight elements from pivoting open further than in the operational configuration.

3. The crane boom segment according to claim 1, wherein the first and second planar lattice webs comprise straight elements of increasing length to provide a crane boom segment which tapers out in the operational configuration.

4. A modular crane, comprising:

a travelling base frame which allows for travel of said crane over a surface; and a crane boom assembled from crane boom segments according to claim 1, wherein one end of the crane boom is hingedly connected about a substantially horizontal pivot axis to said travelling base frame.

5. A method of constructing a crane boom by interconnecting multiple crane boom segments, each crane boom segment comprising:

a first and second planar latticed truss, each with two chords between which permanent lacing elements extend, wherein both chords of each planar latticed truss comprise segment connection parts at head ends thereof, allowing crane boom segments to be connected to each other in series, and wherein in the operational configuration the first and second planar latticed trusses are provided at opposite sides of the longitudinal axis of the crane boom segment; and a first and second lattice web, each lattice web connectable to one of the chords of the first planar latticed truss and one of the chords of the second planar latticed truss, wherein the first and second lattice webs are accordion-type lattice webs, each composed of multiple straight elements that are pivotably interconnected in series by hinges each having a pivot axis, wherein in the folded transport configuration the straight elements are essentially parallel to each other, and in the operational configuration the interconnected straight elements have been pivoted open to form V-shaped pairs of straight elements, wherein the hinges each comprise a fastener member and the chords are provided with complementary fastener members to allow the accordion-type lattice web in the operational configuration connected to the chords, and allow the accordion-type lattice web in the transport configuration to be disconnected from the chords, wherein the chords of a planar latticed truss are each provided with one of said complementary fastener members at ends thereof, and with multiple intermediate complementary fastener members between said end complementary fastener members, all intermediate complementary fastener members and one of the end complementary fastener members having the same mutual distance, and the distance between the other end complementary fastener member and an adjacent intermediate complementary fastener member being half that distance, wherein at the end of a planar lattice truss one chord ends with the mutual distance between the end complementary fastener member and the adjacent intermediate complementary fastener member being half that distance, and the other chord ends with the mutual distance between the end complementary fastener member and the adjacent intermediate complementary fastener member being the distance, wherein the first and second planar latticed trusses are transportable independently of the collapsed, folded-in accordion-type lattice webs, and wherein the method comprises the steps of:

pivoting the interconnected straight elements of both accordion-type lattice webs open from the transport configuration to the operation configuration to form V-shaped pairs of straight elements;

connecting the fastener members of the hinges of the accordion-type lattice webs to the complementary fastener members of the chords of the first and second planar latticed trusses to form a crane boom segment; and interconnecting crane boom segments in series by connecting the segment connection parts at the head ends of the chords.

* * * * *